US011796162B2

(12) United States Patent
Plissey

(10) Patent No.: US 11,796,162 B2
(45) Date of Patent: Oct. 24, 2023

(54) MULTICHAMBERED ILLUMINATED DECORATIVE DISPLAYS

(71) Applicant: Steven Plissey, Boulder, CO (US)

(72) Inventor: Steven Plissey, Boulder, CO (US)

( * ) Notice: Subject to any disclaimer, the term of this patent is extended or adjusted under 35 U.S.C. 154(b) by 18 days.

(21) Appl. No.: 17/839,280

(22) Filed: Jun. 13, 2022

(65) Prior Publication Data

US 2023/0030725 A1 Feb. 2, 2023

Related U.S. Application Data

(60) Provisional application No. 63/227,435, filed on Jul. 30, 2021.

(51) Int. Cl.

| | |
|---|---|
| ***F21V 23/00*** | (2015.01) |
| ***F21V 31/00*** | (2006.01) |
| ***F21S 9/02*** | (2006.01) |
| ***F21W 121/04*** | (2006.01) |
| ***F21Y 115/10*** | (2016.01) |

(52) U.S. Cl.
CPC ..... *F21V 23/003* (2013.01); *F21S 9/02* (2013.01); *F21V 31/00* (2013.01); *F21W 2121/04* (2013.01); *F21Y 2115/10* (2016.08)

(58) Field of Classification Search
CPC ..... F21V 23/003; F21V 31/00; F21S 9/02
See application file for complete search history.

(56) References Cited

U.S. PATENT DOCUMENTS

| | | | |
|---|---|---|---|
| 1,517,848 | A | 12/1924 | McClelland |
| 1,655,345 | A | 1/1928 | Timberlake |
| 4,858,086 | A | 8/1989 | Pietrantino |
| D340,671 | S | 10/1993 | Clark |
| 5,315,492 | A | 5/1994 | Davenport |
| D383,556 | S | 9/1997 | Wang |
| D394,228 | S | 5/1998 | Mehta |
| 6,540,370 | B1 | 4/2003 | Picklo |
| 6,592,952 | B1 | 7/2003 | Ferguson |
| 6,667,079 | B1 | 12/2003 | Glenn |

(Continued)

OTHER PUBLICATIONS

Adams, LED Holiday Wreath Build, https://www.sector67.org/blog/2012/led-holiday-wreath-build/, Dec. 21, 2012, sector67, Madison, Wisconsin, USA.

(Continued)

*Primary Examiner* — Bryon T Gyllstrom

(57) ABSTRACT

Multichambered illuminated decorative displays are presented that can be fabricated in various forms, including annular shapes suitable for holiday exhibition as wreaths and trees. The decorative displays, which may be packaged as kits, include an at least one frame (20); a plurality of translucent chambers (44) mounted to the at least one frame (20); a plurality of addressable LEDs (30) positioned so that at least one LED resides within each chamber; and a plurality of translucent to opaque partitions (46) located between adjacent chambers. As the LEDs (30) light up, the chambers (44) appear to emit a diffuse glow. Simultaneously, the partitions (46) at least reduce or completely block the light transmitted between adjacent chambers (44). Due in part to this combination of light transmission, light diffusion, and at least partial light confinement, the decorative displays can present a wide variety of precisely rendered animations in vivid colors.

21 Claims, 20 Drawing Sheets

(56) References Cited

U.S. PATENT DOCUMENTS

| | | | | |
|---|---|---|---|---|
| 6,830,357 | B2 | 12/2004 | Lopez | |
| D590,294 | S | 4/2009 | Fomby | |
| 7,604,391 | B2 | 10/2009 | Cheng | |
| 10,375,897 | B2 | 8/2019 | Tetreault | |
| 10,962,217 | B1 * | 3/2021 | Zepp | F21V 33/0028 |
| 11,131,902 | B2 * | 9/2021 | Mao | G03B 15/05 |
| 2013/0039089 | A1 * | 2/2013 | Korherr | B60K 35/00 362/551 |
| 2013/0094190 | A1 * | 4/2013 | Gerson | F21V 21/08 362/122 |
| 2014/0160736 | A1 * | 6/2014 | Chung | F21V 7/0016 362/249.02 |
| 2014/0268753 | A1 * | 9/2014 | Buchholz | F21V 7/0066 362/235 |
| 2016/0044217 | A1 * | 2/2016 | Richardson | H04N 23/90 348/207.11 |
| 2018/0220508 | A1 * | 8/2018 | Pilat | F21S 8/061 |
| 2018/0293916 | A1 * | 10/2018 | Tetreault | A01G 5/04 |
| 2021/0215328 | A1 * | 7/2021 | McNamara | F21V 23/06 |
| 2022/0090750 | A1 * | 3/2022 | Hua | F21S 9/037 |

OTHER PUBLICATIONS

Adams, Cheerlights Arduino-controlled RGB LED Holiday Wreath, https://www.youtube.com/watch?v=MjPOFIJPylw&t=2s, Dec. 20, 2012, Youtube post.

* cited by examiner

MULTICHAMBERED ILLUMINATED DECORATIVE DISPLAYS

CROSS-REFERENCE TO RELATED APPLICATIONS

This application claims the benefit of U.S. Provisional Application No. 63/227,435, filed on Jul. 30, 2021.

BACKGROUND

The traditional holiday wreath is an inanimate wallflower. The wreath's boughs occupy fixed positions and cannot be moved. The boughs' colors are similarly fixed and cannot be altered. The overall presentation is static, stale, and more than a bit stodgy. Accordingly, a need exists for an improved version of the conventional holiday wreath. Prior iterations of artificial displays have sought to address one or more limitations of standard wreaths. As will be seen, the decorative displays described below offer a wide-ranging set of solutions through the use of one or more wreath-like apparatuses.

SUMMARY

The decorative displays are illuminated by a plurality of addressable and electrically connected light emitting diodes (LEDs). The LEDs also electrically connect to an at least one LED controller that regulates brightness levels, color palettes, and animation schemes. The at least one LED controller receives instructions from one or more electrically connected and/or wireless signaling devices. The LEDs, the at least one LED controller, and, if included, the one or more electrically connected signaling devices, all connect to one or more power sources, which in some instances may include a battery pack and/or a direct current power supply.

When the decorative displays take the form of an illuminated wreath, the understructure includes a frame. Mounted to this frame are multiple chambers that include translucent material. The illuminated wreath further comprises a plurality of translucent-to-opaque partitions. Each partition is disposed between each adjacent chamber so as to reduce or completely block light transmissions. Within each chamber resides at least one addressable LED. When illuminated, each such LED emits light—typically colored light—so that the exterior of the chamber, which is much larger than the LED, appears to emit a diffusive glow. At the same time, the partitions at least reduce light transmissions between adjacent chambers. Due in part to this combination of light transmission, light diffusion, and at least partial light confinement, vividly colored animations can be presented in which one or more chambers appear to dance along the illuminated wreath's exterior.

Several decorative displays can be used to form an illuminated tree by horizontally placing layers of progressively smaller displays up the length of a center post. Each such display layer includes many of the elements summarized above regarding the illuminated wreath: the frame; the multiple chambers mounted to the frame; the partitions positioned between adjacent chambers; and the addressable LEDs disposed so that at least one LED resides within each chamber. The chambers, which are much larger than the LEDs, include translucent materials that diffuse emitted light to display a soft glow. In contrast, the partitions include translucent to opaque materials that partially or completely block light from passing between chambers. Due in part to this combination of light diffusion, light transmission, and at least partial light confinement, vividly colored animations can be presented in which one or more chambers appear to dance along the illuminated tree's exterior.

DESCRIPTION OF DRAWINGS

In the following detailed description, reference is made to the accompanying drawings that form a part hereof, and in which is shown by way of illustration specific illustrative embodiments. However, it is to be understood that other embodiments may be utilized, and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

In accordance with common practice, the various described features are not drawn to scale but are drawn to emphasize specific features relevant to the exemplary embodiments.

DETAILED DESCRIPTION

Whether in the form of an illuminated wreath or an illuminated tree, the decorative displays include the following: (1) an at least one frame 20, which provides a supporting structure; (2) an LED lighting system, which delivers a wide variety of colorful animated effects; (3) an at least one chamber array 44, which gives the decorative displays an outward form and helps to diffuse light from the LED lighting system; and (4) a plurality of partitions 46 that partly or completely blocks the transmission of light between adjacent chambers.

As used herein, including the claims, the terms "LED," "LEDs," and "addressable LEDs," are used interchangeably to reference LEDs that are addressable (as defined herein). As used herein, including the claims, the term "addressable" means: (1) that each individual LED can be identified and activated or manipulated independently of surrounding individual LEDs; or (2) that each individual LED belongs to a group of two-to-six LEDs that can be identified and activated or manipulated independently of surrounding groups of two-to-six LEDs. Further, as used herein, including the claims, the terms "LED," "LEDs," and "addressable LEDs," are used interchangeably to reference any shape of LEDs or LED bulbs, including but not limited to bullet-shaped, dome top, fairy lights, flat top, M5, M6, surface mount, round, rectangular, square, and also various low-profile shapes typically used in LED strips. As used herein, the phrase "any of a variety of fasteners" includes, but is not limited to, any one or more of the following fasteners, or any combination thereof: adhesives, adhesive tapes, anchors, bolts, bezels and rings, cables, clips, clamps, clasps, couplings, dowels, frictional fittings, hooks, hooks and loops, latches, nuts, pins, rivets, screws, snaps, snap-fit connectors, snap rings, straps, washers, wires, and zip ties. This list of fasteners is not meant to be limiting and any fastener system known in the art can be used. Also, as used herein, including the claims, the terms "decorative display" and "decorative displays" mean illuminated wreaths, illuminated trees, and any other shapes of multichambered illuminated decorative displays.

Figure 1:
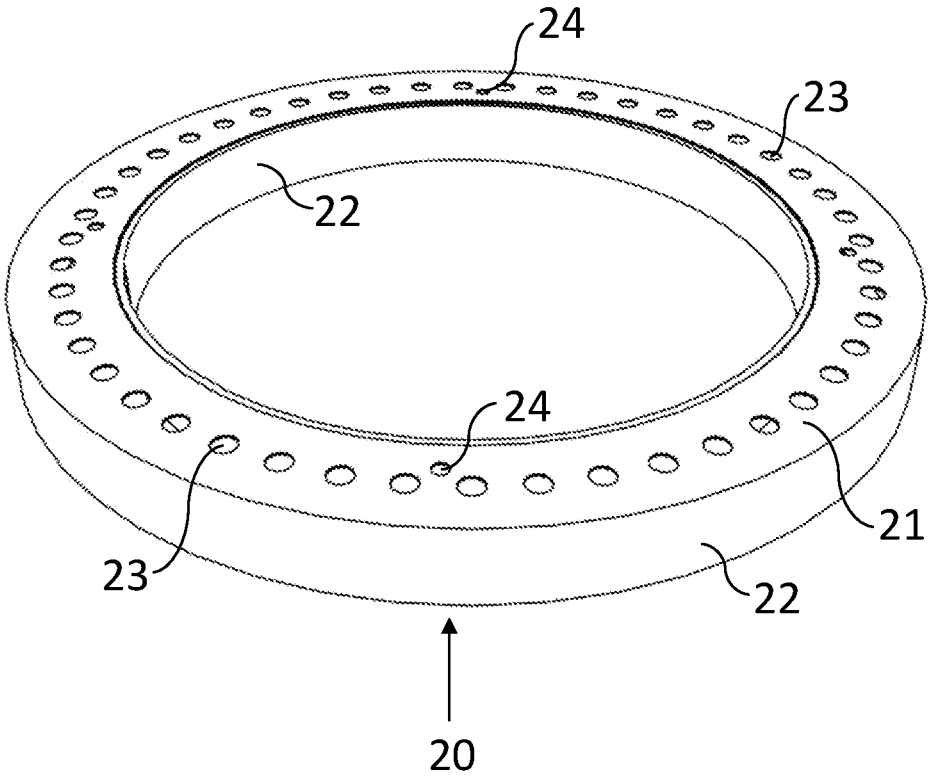
FIG. 1 is a top perspective view of an example frame of an illuminated wreath without LEDs.
Figure 2:
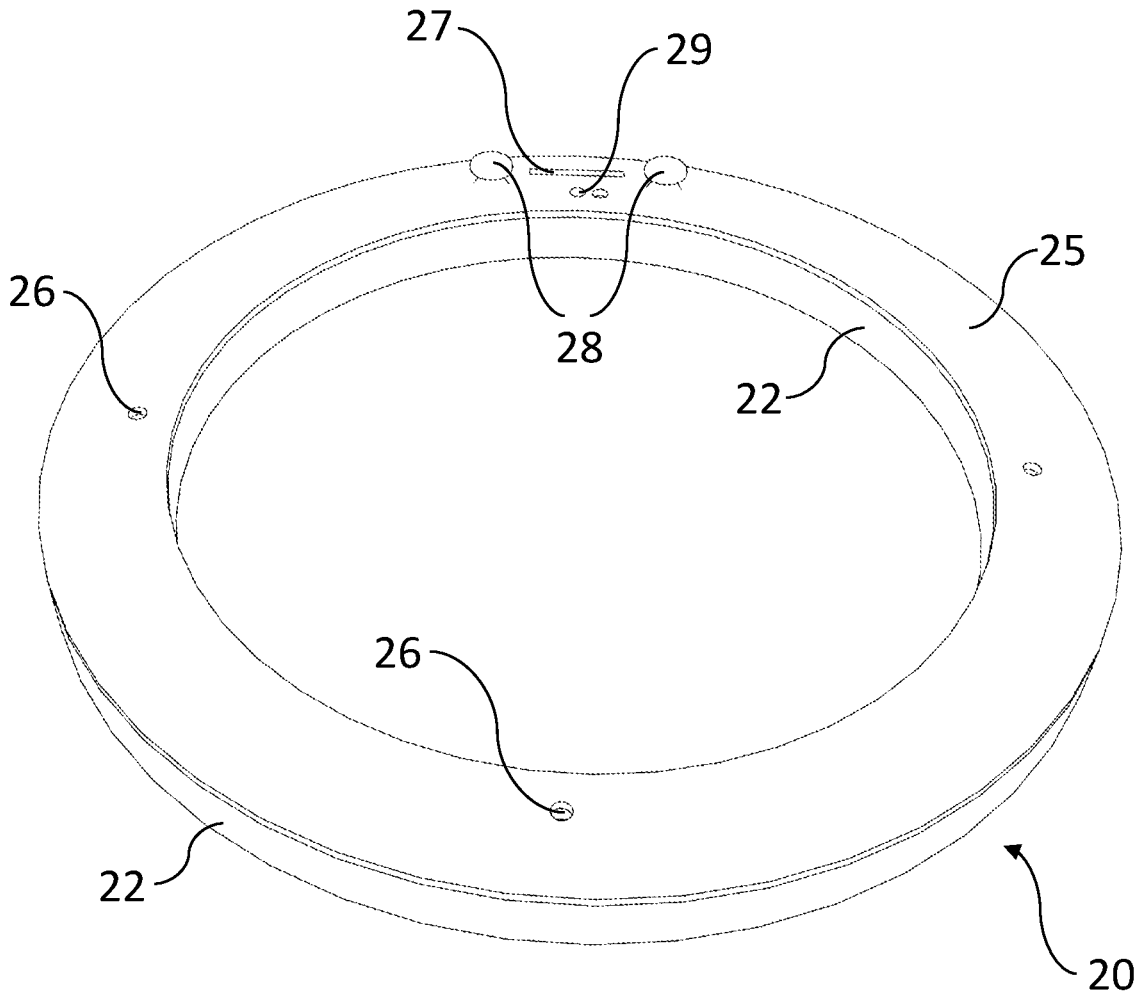
FIG. 2 is a rear perspective view of an example frame of an illuminated wreath.

Frame—FIGS. 1-2

The example of FIG. 1 shows a top perspective view of the frame 20 for an illuminated wreath. In this example, the frame 20 is constructed in a substantially annular shape having inner and outer perimeters that are largely rounded. In other embodiments, the inner and outer perimeters of the frame 20 can exhibit more discrete vertices. In the example of FIG. 1, the frame 20 includes a top frame wall 21 and an at least one side frame wall 22. In other instances, one or more sides of the frame 20 can be unenclosed. In other instances, moreover, the frame 20 can assume forms other than depicted in FIG. 1, including but not limited to tubular rings, wheel-like rims, flattened discs, and spools. In some instances, parts of the frame 20 can include one or more reflective surfaces to boost the transmission of light through the exterior surfaces of the illuminated wreath.

In the instance shown in FIG. 1, the top frame wall 21 includes a single ring of LED insertion holes 23. In other instances, one or more dimensions of the top frame wall 21 can be increased to accommodate more LED insertion holes 23 than are shown in FIG. 1. In other examples, the LED insertion holes 23 can be arranged in patterns other than the single ring depicted in FIG. 1, including but not limited to concentric rings, starbursts, spirals, zig-zags, staggered patterns, or irregular patterns. In some examples, the LED insertion holes 23 can be located on an at least one side frame wall 22. In some instances, the LED insertion holes 23 can be omitted and other fastening techniques or any of a variety of fasteners can be used for securely attaching elements of the LED lighting system to one or more parts of the frame 20.

In the example of FIG. 1, the top frame wall 21 includes several top frame wall coupling holes 24 that facilitate the attachment of the frame 20 to other parts of the decorative display. In other instances, the top frame wall coupling holes 24 can be fewer or greater in number. In other instances, the top frame wall coupling holes 24 can be dispensed with in favor of other fastening techniques or any of a variety of fasteners for attaching the frame 20 to other parts of the decorative display.

A perspective view of an example rear frame wall 25 is shown in FIG. 2. In FIG. 2, the rear frame wall 25 includes several rear frame wall coupling holes 26 that align with the top frame wall coupling holes 24 depicted in FIG. 1. The rear frame wall coupling holes 26 facilitate the attachment of the frame 20 to other parts of the decorative display. As also depicted in FIG. 2, the rear frame wall 25 includes an at least one connecting structure such as a hanger slot 27 and a pair of hanger protrusions 28 to accommodate hanging, suspending, or mounting the illuminated wreath on a wall or other substantially vertical surface. In some instances, other connecting structures for the illuminated wreath can be used, including but not limited to hooks, hoops, slots, mounting holes, and/or protrusions located on any part of the frame 20, including the side frame wall 22. In some instances, the rear frame wall 25 can include additional protrusions that match the height of the pair of hanger protrusions 28 to help assure that the illuminated wreath hangs parallel when suspended against a substantially vertical surface. Additionally, FIG. 2 shows an example of an at least one wire exit hole 29 to accommodate the passage of wires. In other instances, the wire exit hole 29 can be located elsewhere on the frame 20. In some embodiments, the rear frame wall 25 can be removable in whole or in part to allow access to the frame's interior. In such embodiments, the rear frame wall 25 can include routed groves that fit over the top edges of the side frame walls 22.

In some instances, the frame 20 can be fabricated as a plurality of joinable segments and then pieced together using any of a variety of fasteners. In some examples, each segment of the frame 20 can include a plurality of built-in joining elements that can be connected to corresponding built-in joining elements located on other parts of the decorative display. In some instances, the final assembly of the segmented frame 20 can be performed by the consumer to reduce the costs of manufacturing, warehousing, packaging, and shipping.

LED Lighting System—FIGS. 3-8

Figure 3:
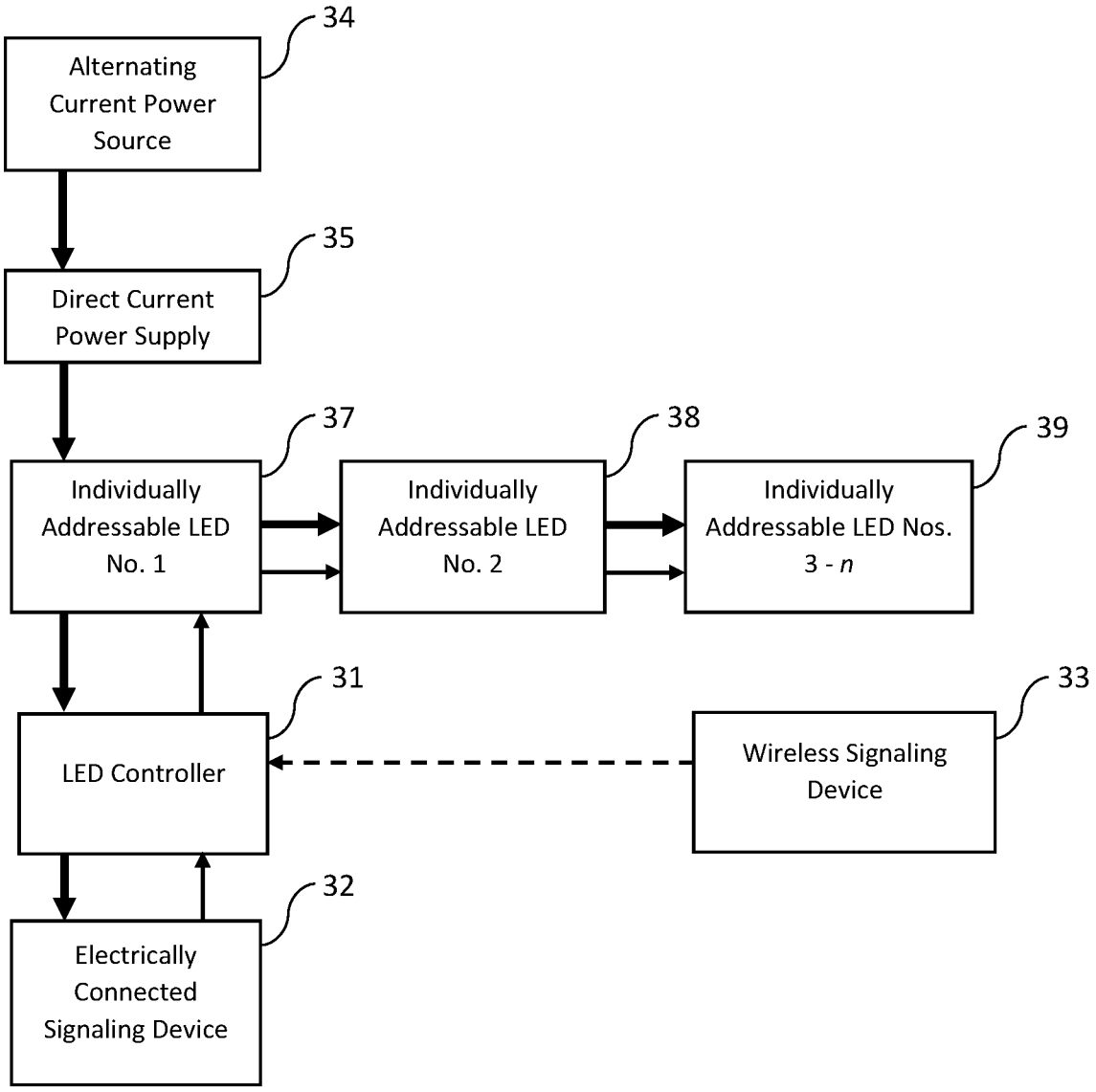
FIG. 3 is a diagram illustrating a first example of an LED lighting system.
Figure 4:
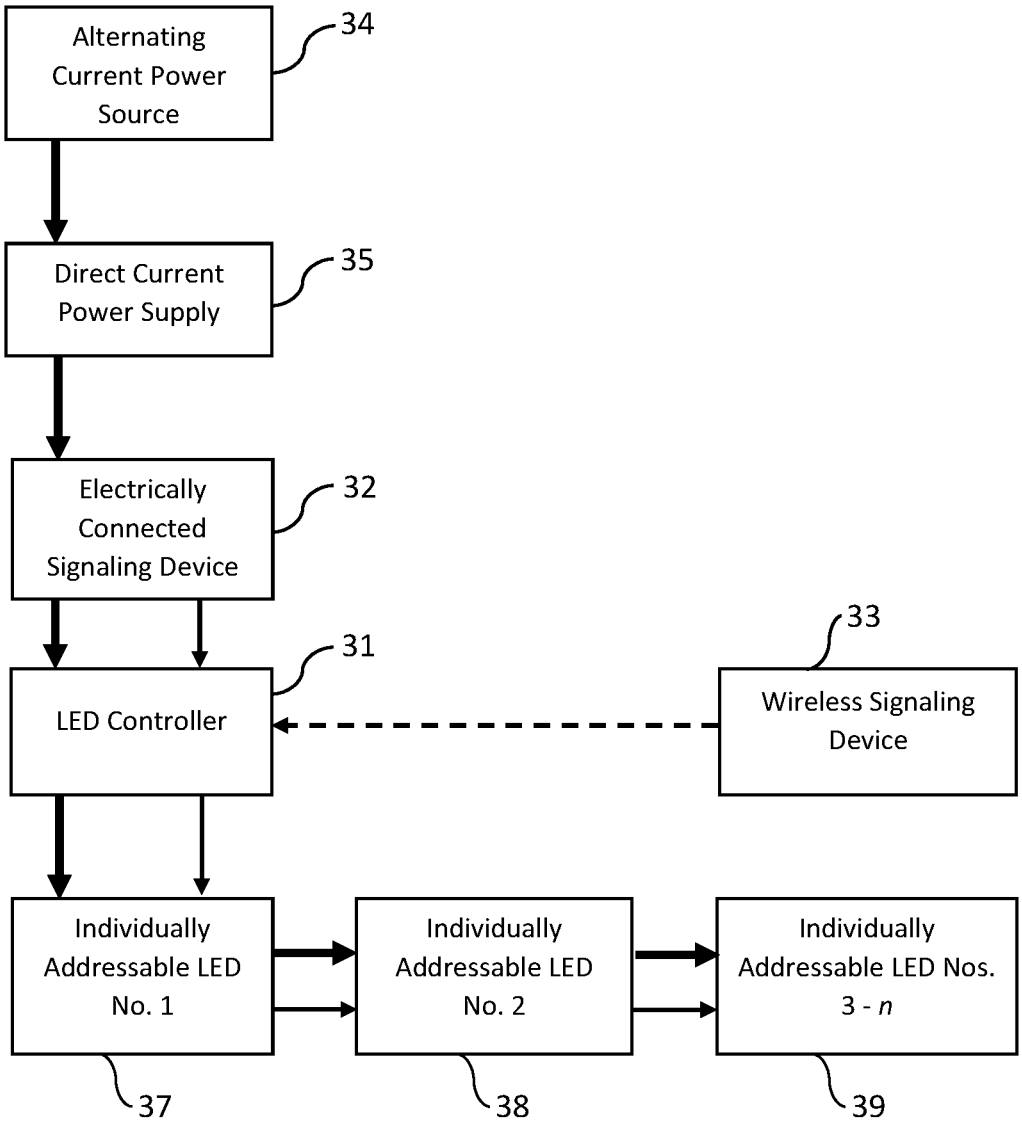
FIG. 4 is a diagram illustrating a second example of an LED lighting system.
Figure 5:
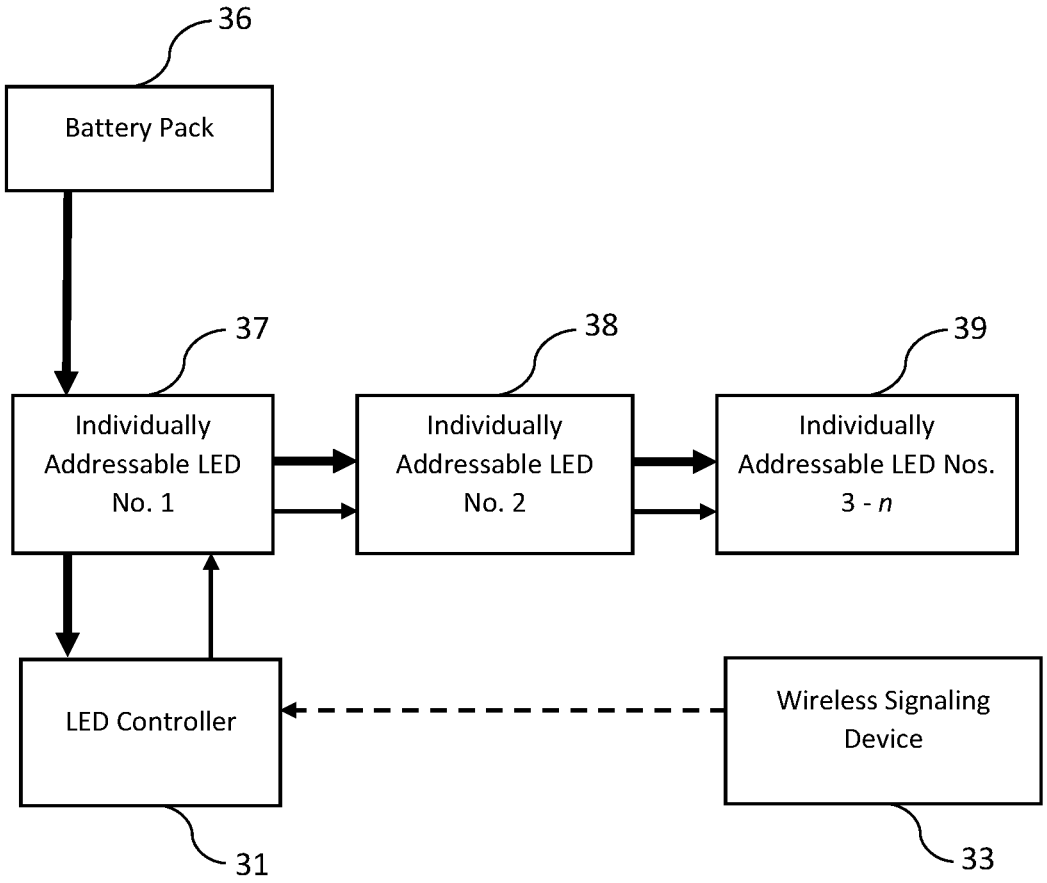
FIG. 5 is a diagram illustrating a third example of an LED lighting system.

As shown in the various examples of FIGS. 3-5, the LED lighting system for the decorative displays includes a plurality of addressable and electrically connected LEDs 30, an at least one LED controller 31, an at least one signaling device 32-33 (including but not limited to one or more remote controls, rotary switches, switches, phone apps, timers, sound-activated synchronizers, sensors that measure ambient light levels, voice-activated digital assistants, etc.), and an at least one source of electrical power 34-36. Using commercially available software, MIT-licensed software, modified versions thereof, or independently developed software, the LED lighting system displays a wide variety of animation effects that can be adjusted by the consumer for speed, color palettes, and brightness levels. These animation effects include but are not limited to: (1) flash effects in which the decorative display cycles through various color sequences; (2) shadow effects in which unlit areas traverse the length of the otherwise illuminated decorative display; (3) wiping effects in which the decorative display initially shows one color and then slowly transitions to a new color;

(4) scan effects in which one area of the decorative display consisting of a single color travels against a solid background exhibiting another color; and (5) meteor effects in which a bright nucleus blazes a path across the decorative display followed by a fading tail.

The diagram in FIG. 3 depicts a first example of an LED lighting system for supplying electrical power and data to the decorative displays. In this example, the flow of electrical power, indicated by the thicker line with an arrow, originates from an alternating current power source 34 that connects by wires or other electrical connection to a conventional direct current power supply 35. The conventional direct current power supply 35 electrically connects to an addressable LED No. 1 37, which in turn electrically connects to an addressable LED No. 2 38, which in turn electrically connects to an addressable LED Nos. 3-n 39, with the "n" representing the total number of the addressable LEDs 37-39. In the example of FIG. 3, the electrical power also flows via wires or other electrical connection from the addressable LED No. 1 37 to an LED controller 31, which is programmed to selectively address the presentation of colors, brightness levels, and illumination sequences for all of the addressable LEDs 37-39. In the example of FIG. 3, the LED controller 31 relays direct current power to an electrically connected signaling device 32. The electrically connected signaling device 32 returns lighting effect instructions, indicated by the thinner solid line with an arrow, back to the LED controller 31, which then relays data regarding lighting effects via wire or other electrical connection to the addressable LED No. 1 37. The lighting effects data then travels by wire or other electrical connection from the addressable LED No. 1 37 to all the other addressable LEDs 38-39.

In the first example depicted in FIG. 3, the illumination of the LEDs and their lighting effects can also be adjusted using a wireless signaling device 33 (in FIG. 3 wirelessly transmitted instructions are indicated by a dashed line with an arrow). The wireless signaling device 33 can use any of several widely available short-range wireless technology standards and in some instances can include one or more user interface apps that the consumer downloads to a cell phone. In other examples, the conventional direct current power supply 35 can connect to the LED controller 31, which via wires or other electrical connection transmits power and data to all the addressable LEDs 37-39. In some instances, the electrically connected signaling device 32 can be located onboard the decorative displays. In some instances, the electrically connected signaling device 32 can be installed in the connective wires at a suitable point between the exterior of the decorative displays and the alternating current power source 34 or the conventional direct current power supply 35. In some instances, an on-off switch can be installed in the wires at a suitable point between the alternating current power source 34 and the conventional direct current power supply 35. In some instances, all the addressable LEDs 37-39 can be powered by the alternating current power source 34 instead of by direct current. In such instances, no direct current power supply 35 is present. In such instances, an on-off switch can be installed in the wires at a suitable point between the alternating current power source 34 and the addressable LED No. 1 37.

The diagram in FIG. 4 depicts a second example LED lighting system of the decorative displays for supplying electrical power and data to the addressable LEDs 37-39. In the example of FIG. 4, the most proximate power source to the decorative display is a conventional direct current power supply 35 that connects to the conventional alternating current power source 34. The conventional direct current power supply 35 connects to the electrically connected signaling device 32. The electrically connected signaling device 32 sends both electrical power and lighting effect instructions, indicated by the thinner solid line with an arrow, to the LED controller 31, which then relays not only electrical power; but also lighting effects data via wire or other electrical connection to the addressable LED No. 1 37. The remaining electrical and wireless connections depicted in FIG. 4 are substantially as described in connection with FIG. 3 above.

The diagram in FIG. 5 depicts a third example LED lighting system of the decorative displays for supplying electrical power and data to all the addressable LEDs 37-39. In the example of FIG. 5, the power source is a battery pack 36 and the sole signaling device is a wireless signaling device 33. The remaining electrical connections depicted in FIG. 5 are substantially as described in connection with FIG. 3 above. In other instances, both the battery pack 36 and the conventional direct current power supply 35 can be available to power the LED lighting system. In examples in which the battery pack 36 is installed onboard the frame 20, the decorative displays can be exhibited cordlessly. It should be understood that in some embodiments the electrically connected signaling device 32 may include automated methods for sending instructions to the LED controller 31 that don't require human intervention via controls or switches. These automated methods include but are not limited to timers, sound-activated synchronizers, and sensors that adjust the brightness levels of the addressable LEDs 37-39 based upon ambient light conditions. In addition to the examples depicted in FIGS. 3-5, the decorative displays can utilize other examples of LED lighting systems.

Figure 6:
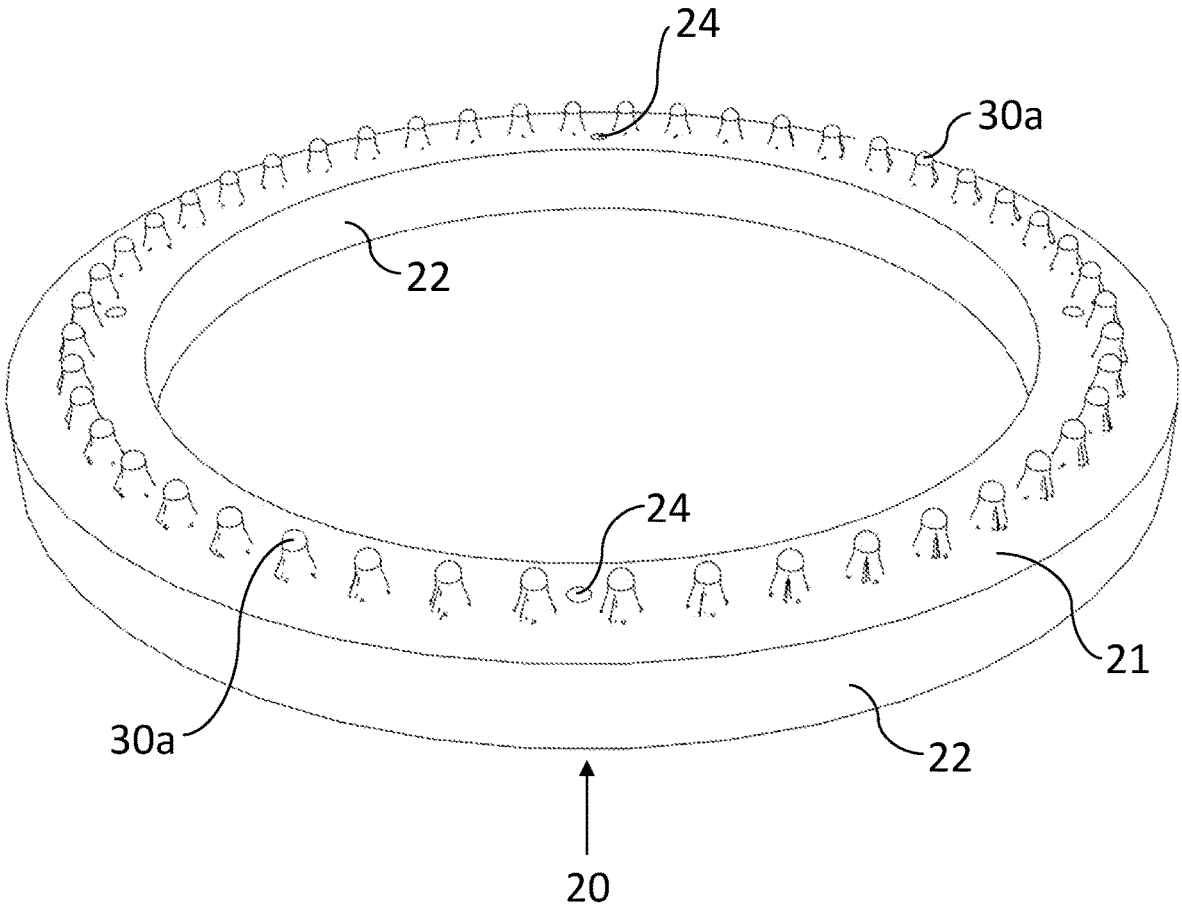
FIG. 6 is a top perspective view of an example frame of an illuminated wreath with bullet-shaped LEDs installed.

The drawing in FIG. 6 depicts an example frame 20 of the illuminated wreath as viewed from above the top frame wall 21. In FIG. 6, a number of addressable bullet-shaped LEDs 30*a* have been positioned in the LED insertion holes 23 (see FIG. 1) so that their illuminable tips protrude above the surface of the top frame wall 21. In FIG. 6, the bullet-shaped LEDs 30*a* are arranged in the shape of a ring along the surface of the top frame wall 21. In other examples, the LED insertion holes 23 and the LEDs 30 can be arranged in other patterns, for example, including but not limited to concentric rings, starbursts, spirals, zig-zags, staggered patterns, or irregular patterns. In some instances, techniques other than that depicted in FIG. 6 can be used to attach the LEDs 30 to the decorative displays.

Figure 7:
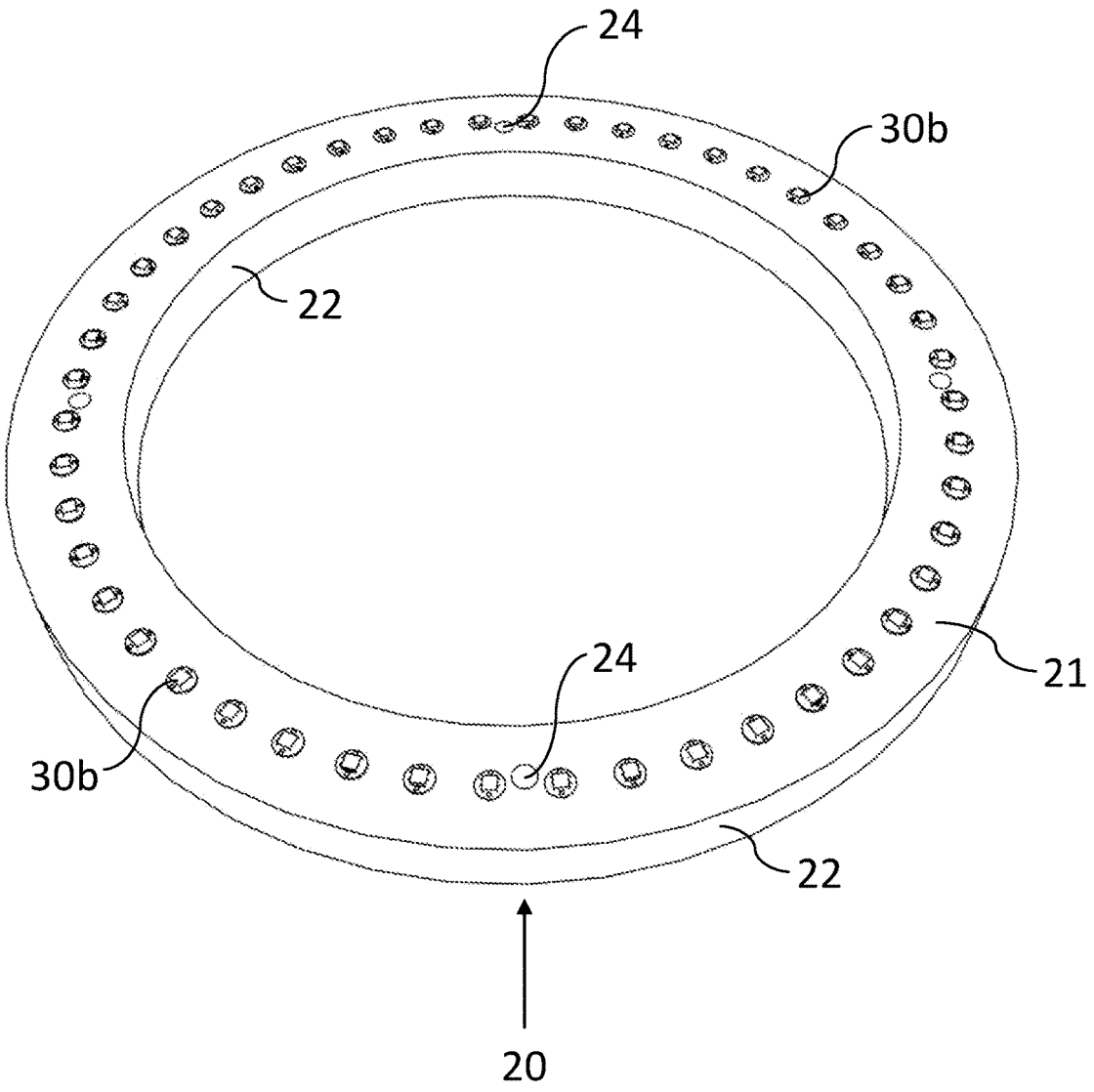
FIG. 7 is a top perspective view of an example frame of an illuminated wreath with low-profile LEDs installed.

Whereas FIG. 6 depicts bullet-shaped LEDs 30*a*, the example in FIG. 7 shows the use of low-profile LEDs 30*b* similar to those typically included in LED strips. The low-profile LEDs 30*b* in FIG. 7 are attached to the top frame wall 21 using adhesives. In some instances, other fastening techniques or any of a variety of fasteners can be used for securely attaching the LEDs 30 to the decorative displays.

Figure 8:
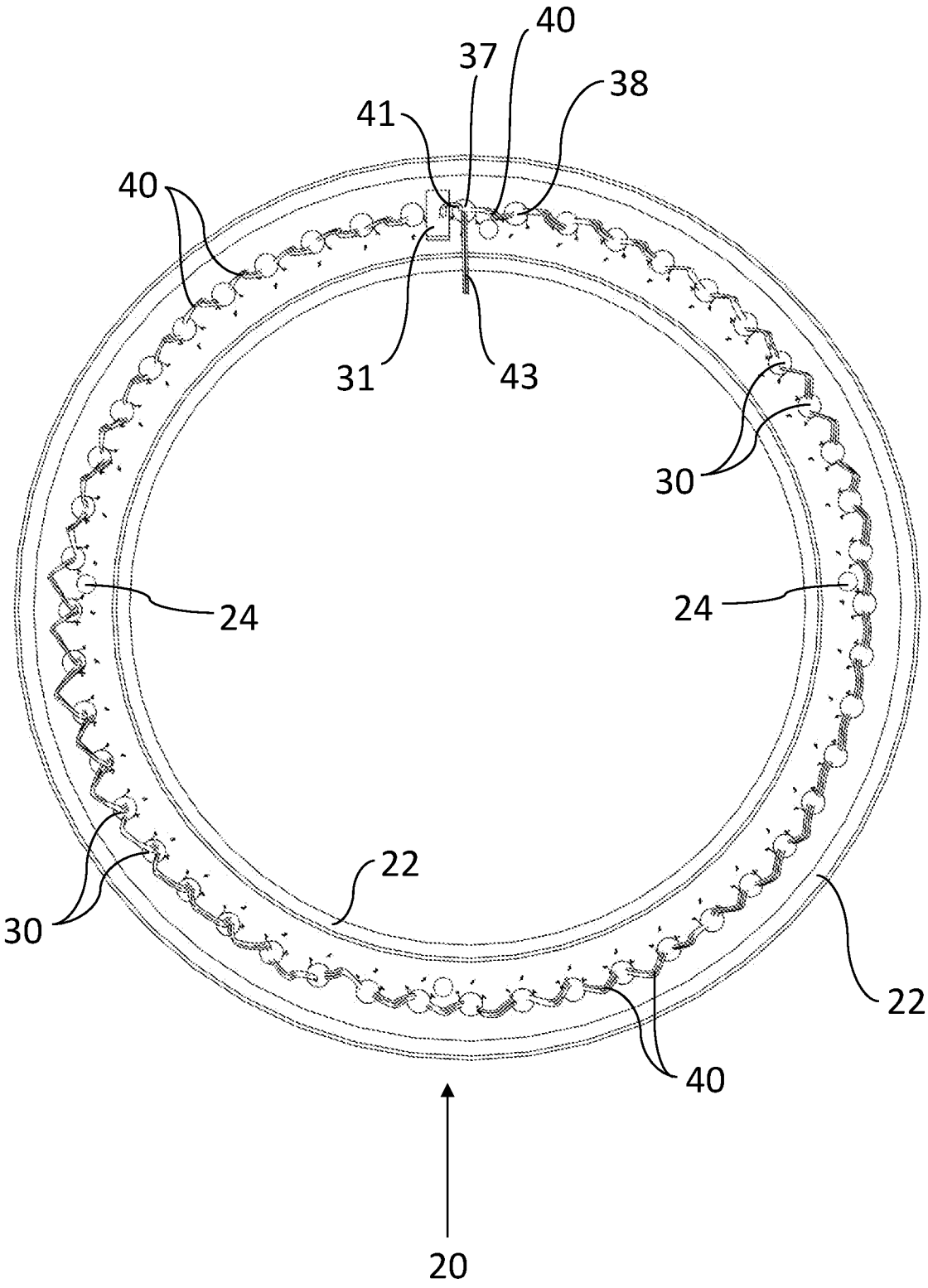
FIG. 8 is an overhead view of an example underside top frame wall of an illuminated wreath with elements of an LED lighting system installed.

FIG. 8 shows the underside of the top frame wall 21 shown in FIG. 1 and FIG. 6 without depicting the rear frame wall 25. In some instances, the underside of the top frame wall 21 can include a plurality of reinforcement structures that bridge the side frame walls 22 so as to increase the rigidity of the frame 20. FIG. 8 shows the bases of the addressable LEDs 30. As depicted, the LEDs 30 are linked to each other at their bases by a first set of three wires 40. In the example shown, each wire in the first set of three wires 40 performs a discrete function relating to the operation of the LEDs 30: data, ground, and power. In other instances, additional wires can be added that perform other functions.

In some instances, the connection between the addressable LEDs 30 can be achieved through electrical connections other than wires, such as the types of electrical connections typically used in circuit boards or LED strips.

In the example shown in FIG. 8, the addressable LED No. 1 37 in the plurality of addressable LEDs 30 has a total of eight wires inserted into its base. In other instances, a greater or fewer number of wires can be inserted into the addressable LED No. 1 37. In the example of FIG. 8, the first set of three wires 40 connects the addressable LED No. 1 37 to an addressable LED No. 2 38 and thereafter to other addressable LEDs 30. A second set of three wires 41 connects the addressable LED No. 1 37 to the LED controller 31. In other instances, a greater or fewer number of wires can connect the addressable LED No. 1 37 to the LED controller 31. The LED controller 31, which in the example of FIG. 8 is located within the frame 20 next to the addressable LED No. 1 37, can in other instances be located elsewhere within the decorative display or can be installed in the connective wires at a suitable point between the exterior of the decorative displays and the alternating current power source 34 and/or the direct current power supply 35. A set of two wires 43 inserted into the addressable LED No. 1 37 connects to the conventional alternating current power source 34 (not shown) and/or the conventional direct current power supply 35 (not shown).

In some examples, electrified elements of the decorative displays (including the LEDs 30, the at least one LED controller 31, the battery pack 36, any electrically connected signaling device 32, and the conventional direct current power supply 35) can be housed within one or more weather protective covers, including but not limited to encasements that qualify for IP53 or higher ratings. Such containers and encasements facilitate the outdoor exhibition of the decorative displays. In some instances, the exterior of the decorative display can be fabricated to serve as an enclosed weather protective cover for all electrically connected elements housed therein. In the case of the low-profile LEDs 30*b*, the weather protective cover can in some instances include a heavy overlayer of silicone or some other similar transparent material. This is a conventional method for weatherproofing LED strips. In the case of the bullet-shaped LEDs 30*a*, the weather protective cover can involve injecting the interior of the bulb casing with silicone or other similar transparent material. This is a conventional method for weatherproofing bullet-shaped LEDs 30*a*.

Chambers—FIGS. 9-13

Figure 9:
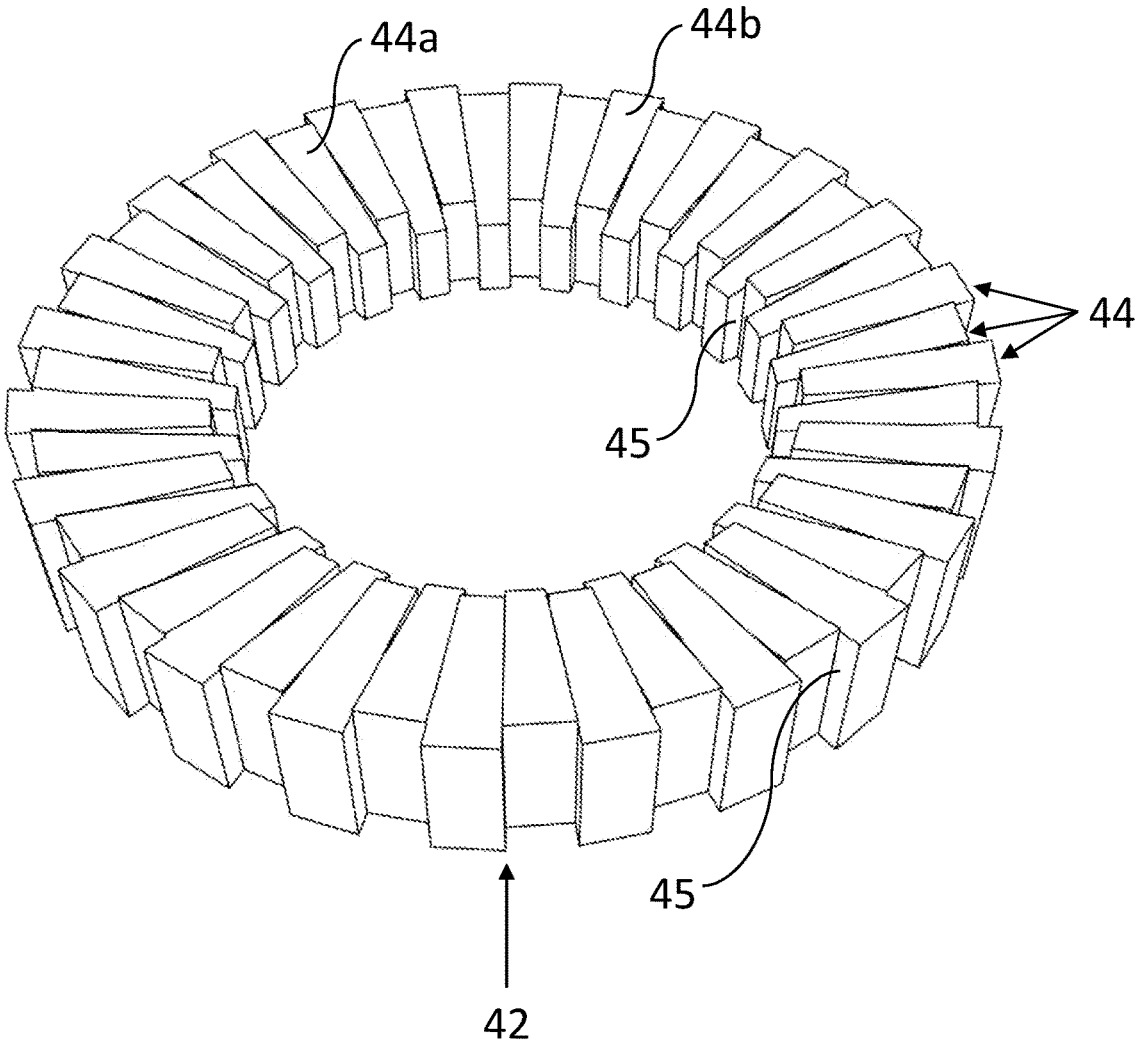
FIG. 9 shows an example chamber array for an illuminated wreath.

An example exterior of a chamber array 42 for an illuminated wreath is depicted in FIG. 9. In this embodiment, the chamber array 42 includes a number of chambers 44 arranged in a substantially annular formation. Each chamber 44 is hollow and substantially shaped as a trapezoidal prism. Each of the chambers 44 comprises multiple faces, including side faces 45. In this example, the side faces 45 are only partially exposed to view on the exterior of the chamber array 42, while other faces of the chambers 44 are fully exposed to view.

In FIG. 9, chambers 44 with different-sized exterior volumes are alternately positioned to form the substantially annular chamber array 42: first a small chamber 44*a*; and then, next to it, a large chamber 44*b*. Also, each of the small chambers 44*a* is radially positioned closer to the center of the chamber array 42 as compared to each of the large chambers 44*b*. As shown in FIG. 9, this radially-varied arrangement of different-sized chambers 44*a*-44*b* produces a distinctive pattern of ridges and valleys along the exterior surfaces of the chamber array 42. Such surface variations boost the visual interest of the decorative displays even when such displays are unlit. In other examples, other positionings of different-sized chambers 44*a*-44*b* can be used to produce any number of different patterns along the exterior surfaces of the chamber array 42. In other examples, the same chamber array 42 can include more than two different sizes of chambers 44. Moreover, the same chamber array 42 can include more than two different positions for any offset chambers 44. Such positionings can include offsets in directions other than those shown in FIG. 9.

In the example of FIG. 9, the chambers 44 are constructed of one or more translucent materials. As used herein, including the claims, the term "translucent material," whether used in the singular or the plural, means material that allows light transmission but is not transparent material (as defined herein). As used herein, including the claims, the term "transparent material" means a material that allows clarity of vision from one side of the material through the other side of the material, enabling the eye to focus on an object located on the other side of the material and observe a substantially undistorted image of the object. In the decorative displays, the precise deployment of translucent material in the chambers 44 is adjusted to reduce "hot spots" of light emanating from the LEDs 30 so that viewers see a softer glow that is more evenly distributed across the exterior of each chamber 44. To achieve this diffusive effect, the chamber faces can be fabricated at thicknesses that reliably produce the desired level of diffusion. If deemed appropriate, in some instances one or more layers of supplemental translucent material can be interposed between the LEDs 30 and one or more faces of the chambers 44. If desired, some or all of the interior and/or exterior surfaces of the chambers 44 can be textured to provide additional light diffusion and enhance the decorative display's appearance when unlit. In some instances, some of the chamber faces can also include semi-opaque or opaque patterns to boost the decorative display's visual interest and further reduce the incidence of LED hot spots. In some instances, at least some exterior faces of the chambers 44 can include a prismatic lens or other diffusing structures. It should be understood that although the translucent materials contained in the chamber arrays 42 and individual chambers 44 will typically be white, other translucent colors can also be used. Such tinted chambers 44 can alter the perceived hue of light emissions from the LEDs 30, but in certain instances that will be an acceptable or even desirable result.

Figure 10:
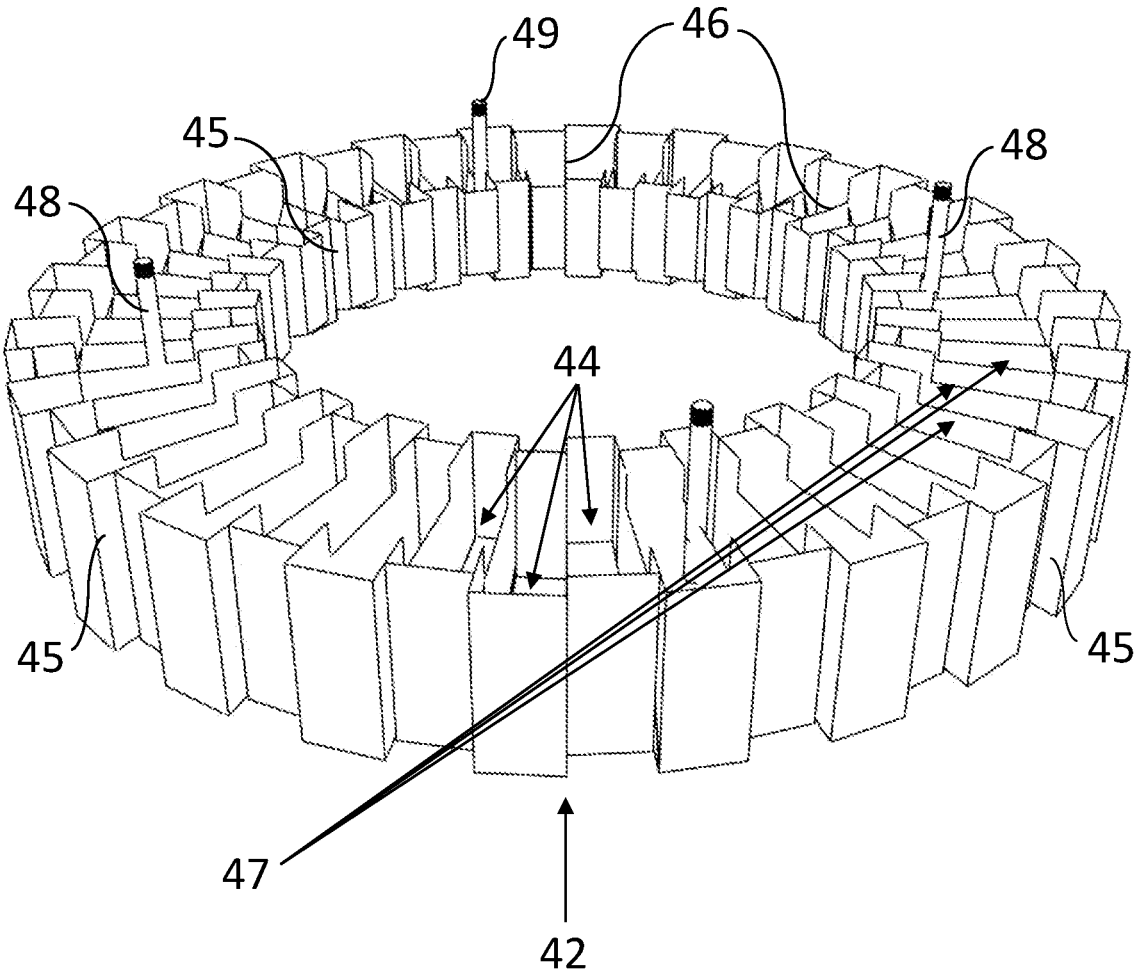
FIG. 10 shows an example underside chamber array for an illuminated wreath.

FIG. 10 depicts an example underside of the chamber array 42. In this example, as in FIG. 9, each of the side faces 45 is partially exposed to view on the exterior of the chamber array 42. However, the vast majority of each side face 45 is not exposed to view; but rather is hidden within the interior of the chamber array 42. This interior portion of the side faces 45, which comprises a thin layer shared by adjacent chambers 44, is what in this instance delineates a plurality of partitions 46. In the decorative displays, the partitions 46 can comprise a wide variety of materials that in terms of opacity range from translucent to fully opaque. In the depicted example, such materials can include but are not limited to reflective coatings, light-absorbing paints, and/or opaque adhesive tapes. These materials facilitate at least reduced light transmissions between adjacent chambers 44. In the decorative displays, the combination of light transmission, light diffusion, and at least partial light confinement contributes to the presentation of vivid colors and precise animations. If this combination of conditions is not adequately calibrated, the visual appeal of the lighting effects can be adversely impacted. For example, without a sufficient level of light confinement, chambers emitting the color white can oversaturate the appearance of adjacent chambers that are emitting softer hues such as red or blue. Also, without adequate light confinement, some animations can appear imprecise and blurry. This tends to occur when chambers that are supposed to be unlit are infiltrated by excessive light from nearby LEDs.

In other examples, which will be discussed in greater detail below, instead of sharing side faces 45 with adjacent chambers, each chamber 44 of a decorative display can instead include its own set of separate side faces 45. In such examples, when the chambers form a chamber array 42 the interior portions of adjacent interior side faces 45 will overlap with one another thereby delineating a plurality of double-thick partitions 46. Due in part to this double layering, such partitions 46 at least reduce and at most completely block the transmission of light between adjacent chambers 44.

In other instances, sufficient confinement of light in a decorative display can be achieved by using partitions 46 that are not part of the chambers 44 but rather constitute separate pieces that attach to one or more parts of the chamber array 42. For example, an ornamental effect can be achieved by interspersing the chambers 44 with partitions 46 that are partially exposed to exterior view and include one or more opaque woods or veneers such as teak or walnut. In other instances, less ornamental materials can be used, including but not limited to plastic panels made of translucent to opaque material.

In some instances of decorative displays one or more of the partitions 46 or portions thereof can attach to the frame 20 instead of or in addition to attaching to some part of the chamber array 42. In some instances, one or more of the partitions 46 fabricated as individual pieces can be securely inserted or frictionally fit into receiving structures (such as channels, crannies, holders, hollows, indents, niches, grooves, seams, sleeves, slots, snap-fit connectors, etc.) located on the underside of the chamber array 42 and/or on the frame 20. In other examples, the partitions 46 can be mounted to the decorative displays using various fastening techniques and any of a variety of fasteners. In some instances, the partitions 46 can include one or more reflective surfaces that not only block light but also boost light transmissions through the exterior surfaces of the chamber array 42. It should also be understood that in some instances one or more of the partitions 46 of the decorative displays can comprise hollow or semi-hollow cavities that effectively inhibit light transmissions at a lower cost by using less material. The inclusion of wider partitions 46 between the chambers 44, regardless of whether such spaces are hollow, semi-hollow, or solid, produces different animations as compared to embodiments that use thinner partitions 46.

In the example of FIG. 10, the interior side faces 45 are notched so that a substantially circular-shaped channel 47 is formed along the underside of the chamber array 42. The top frame wall 21 fits into the substantially circular-shaped channel 47. In some instances, the shape, width, and/or depth of the substantially circular-shaped channel 47 can be varied to achieve the desired combination of light diffusion, chamber brightness, light confinement, display rigidity, and/or any other sought-after characteristics of the decorative displays. Along the substantially circular-shaped channel 47 resides a plurality of the coupling bolts 48, with each such bolt including the threaded end 49. In FIG. 10, the coupling bolts 48 are plastic welded or molded into the chamber array 42 so as to straddle several of the partitions 46. In other examples, the coupling bolts 48 can be attached to the chamber array 42 through various other techniques, including but not limited to techniques discussed in greater detail below.

Figure 11:
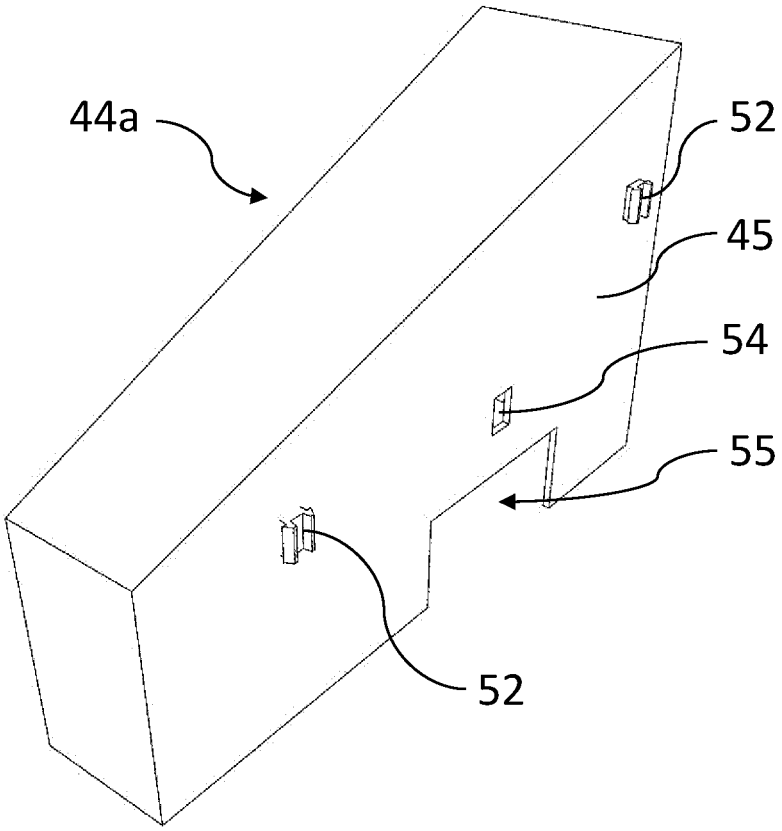
FIG. 11 shows an example small chamber of an illuminated wreath.

FIG. 11 shows an example small chamber 44*a*. A depicted side face 45 includes a pair of snap-fit connectors 52. The pair of snap-fit connectors 52 mounts into a pair of connecting holes 53 located on the side face 45 of an adjacent large chamber 44*b* (see FIG. 12). Similarly, the undepicted side face includes another pair of connecting holes 53 sized to receive a separate pair of snap-fit connectors 52 from the other adjacent chamber. In other embodiments, different numbers, shapes, or configurations of snap-fit connectors and matching connecting elements can be used to connect chambers 44. The depicted side face 45 in FIG. 11 also includes a bolt receiving hole 54 which, as described below, matches up with an identically-sized bolt receiving hole 54 located on the adjacent large chamber 44*b* (see FIG. 12). The small chamber 44*a* also includes a pair of notches 55, one of which is shown on the depicted side face 45. As described in the above discussion of the chamber array 42 depicted in FIG. 10, a plurality of these notches 55 forms the substantially circular-shaped channel 47 into which fits a part of the frame 20.

Figure 12:
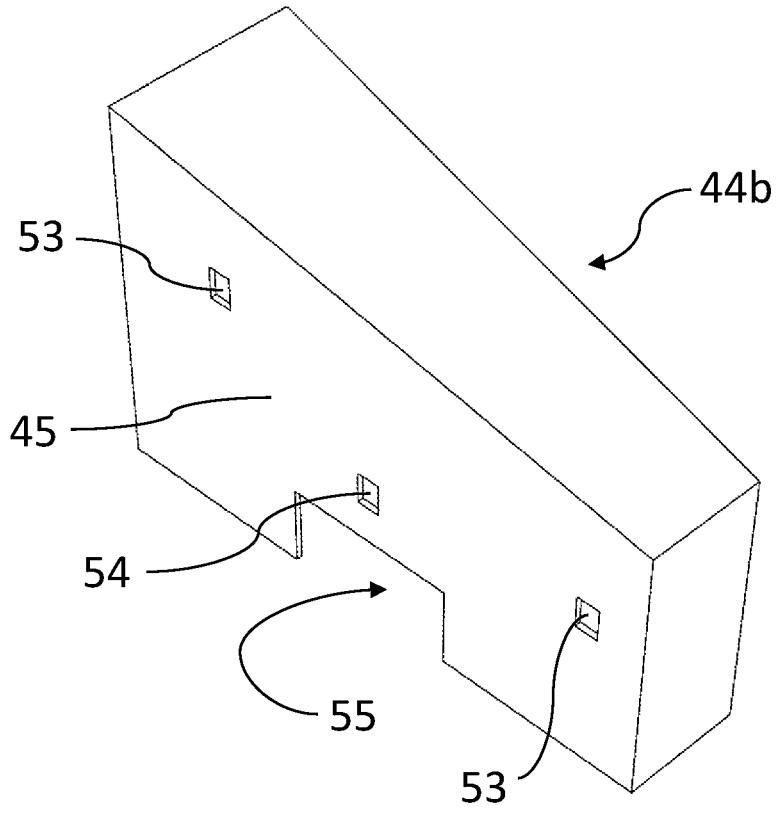
FIG. 12 shows an example large chamber of an illuminated wreath.

FIG. 12 shows an example of the large chamber 44*b* located adjacent to the small chamber depicted in FIG. 11. The depicted side face 45 includes the pair of connecting holes 53 configured to receive the pair of snap-fit connectors 52 previously shown in FIG. 11. The depicted side face 45 also includes the previously mentioned bolt receiving hole 54 that matches up with the same-sized hole located on the adjacent small chamber 44*a* (see FIG. 11). The large chamber 44*b* also includes the pair of notches 55 that, as described in the above discussion of FIG. 11, forms part of the substantially circular-shaped channel 47 into which fits a part of the frame 20.

It should be understood that alternative methods or combinations of methods other than the pair of snap-fit connectors 52 can be used for attaching adjacent chambers 44, including any of a variety of fasteners. Also, in some instances, the chambers 44 can be fabricated in small groupings. This approach decreases the number of connections required to assemble a complete chamber array 42. Further, in some cases, the chamber array 42 can be fabricated as a single piece.

Figure 13:
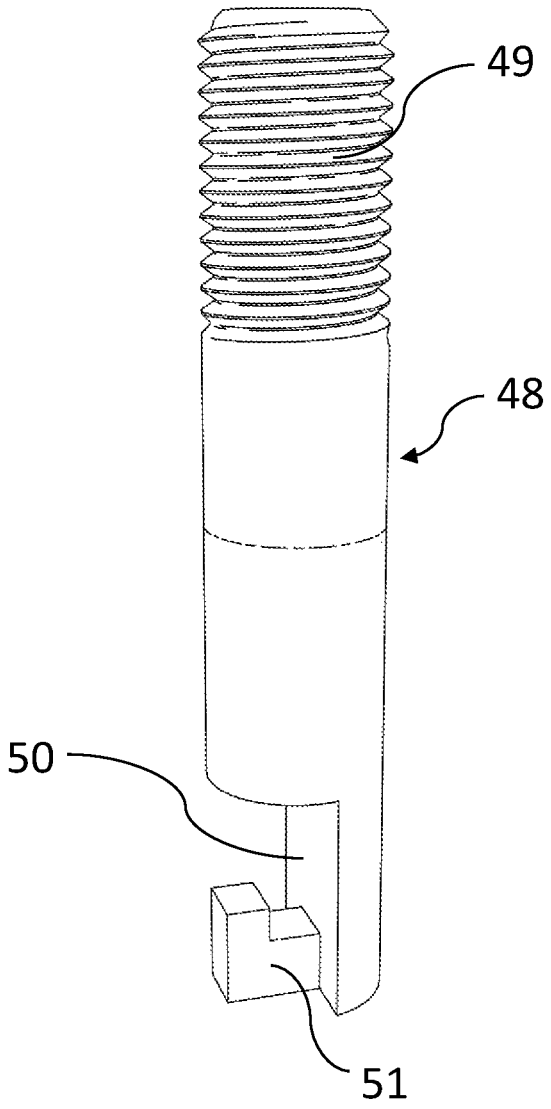
FIG. 13 shows an example coupling bolt of an illuminated wreath.

In FIG. 13, an example fastener in the form of a coupling bolt 48 is depicted. The coupling bolt 48 facilitates the secure attachment of the chamber array 42 to the frame 20. The coupling bolt 48 in this example includes the threaded end 49 and a flat surface 50 that abuts one of the side faces 45. An insertable hook 51 slides through the bolt receiving holes 54 of an adjacent small chamber 44*a* and large chamber 44*b*. The number of coupling bolts 48 contained in a given illuminated wreath will vary in part according to the wreath's size and weight. If no coupling bolt 48 is utilized on any given pair of adjacent chambers 44, such chambers will not include any bolt receiving holes 54.

Figure 14:
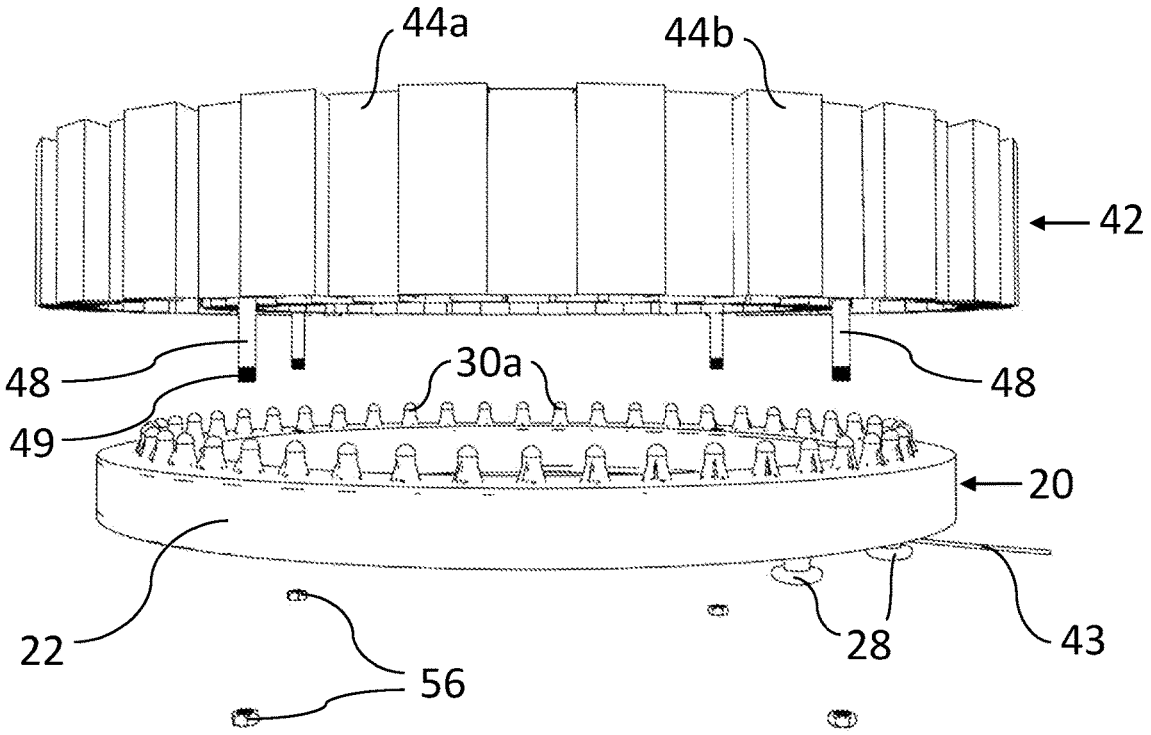
FIG. 14 is a side view of an example chamber array, a frame with elements of an LED lighting system installed, and several coupling nuts.
Figure 15:
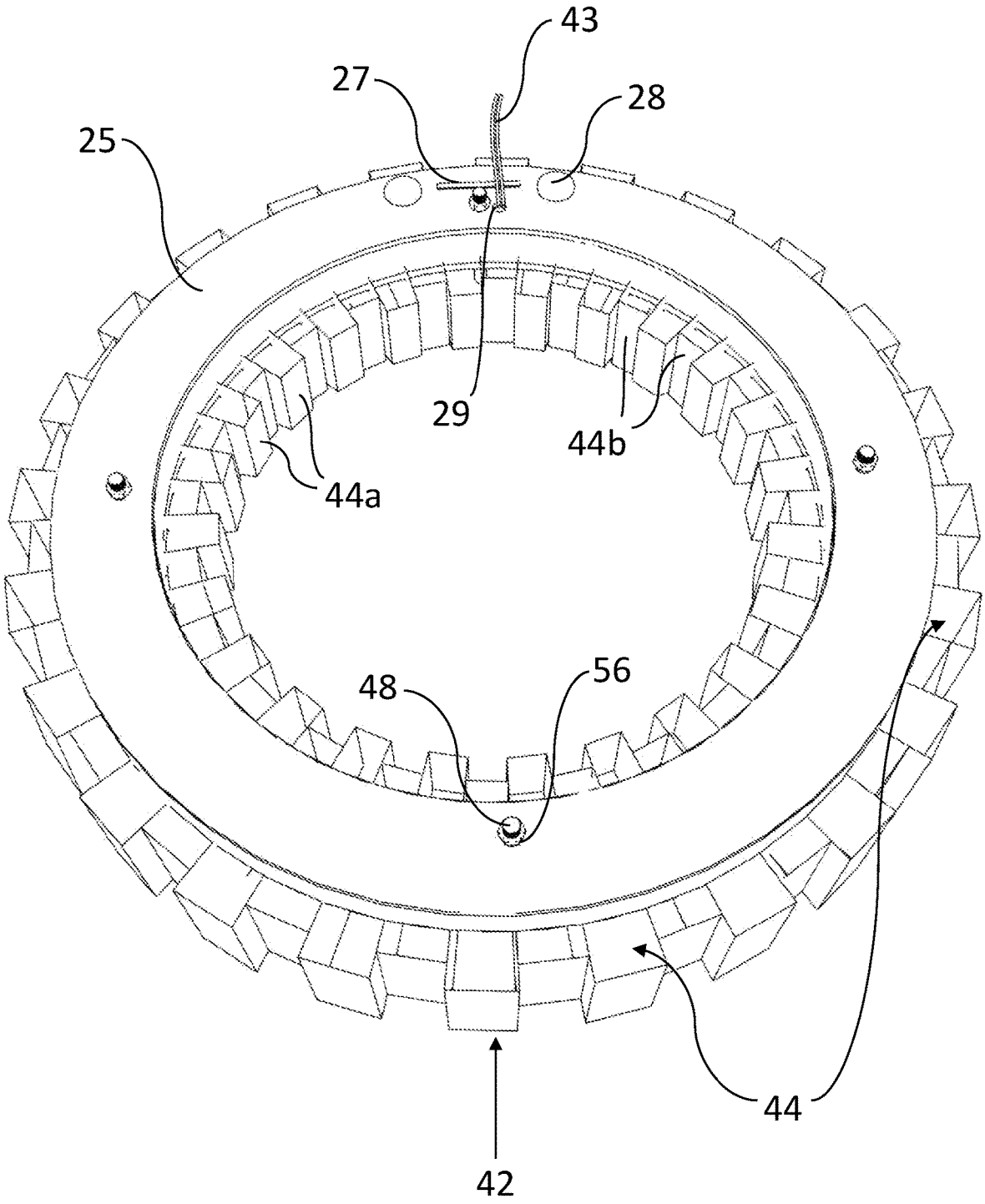
FIG. 15 shows an example underside of an assembled illuminated wreath.

Illuminated Wreath Assembly—FIGS. 14-15

In the example of FIG. 14, the frame 20 fits into the underside of the chamber array 42, with the top frame wall coupling holes 24 and the rear frame wall coupling holes 26 sliding over each of the coupling bolts 48. The frame 20 is secured to the chamber array 42 by tightening a coupling nut 56 onto the threaded end 49 of each coupling bolt 48. In other instances, other techniques can be used for attaching the chamber array 42 to the frame 20. For example, one or more parts of the frame 20 can be fabricated to include parts that securely snap-fit into one or more compatible parts of the chamber array 42 thereby reducing or eliminating the need for fasteners. In other instances, the substantially circular-shaped channel 47 can be omitted and the frame 20 can be made to abut the underside of an unnotched chamber array 42. In yet other instances, the frame 20 can include open slots that slidably fit over the partitions 46 to form a secure attachment. In other instances, the coupling bolts 48 can be dispensed with and any of a variety of fasteners can be used to mount the frame 20 to the chamber array 42.

FIG. 15 shows the underside of an example illuminated wreath after assembly. Each of the coupling nuts 56 has been tightened onto each of the coupling bolts 48. In FIG. 15, the frame 20 covers only part of each chamber's backside. This approach conserves materials; but results in some light escaping through the rear of the chamber array 42. It has been found that this escaped light does not substantially interfere with light animations and actually amplifies lighting effects by projecting a slight halo upon whatever surface the illuminated wreath is hung. In other examples, the backside of the chambers 44 can be fully enclosed so that little if any light escapes through the rear of the illuminated wreath. With the inclusion of inner reflective surfaces, such full enclosures can boost the intensity of light emitted through the chamber array 42.

Instead of substantially trapezoidal prisms (see FIG. 10 and FIG. 11), the chambers 44 for the decorative displays can instead include a wide variety of other hollow three-dimensional shapes, or combinations thereof, including but not limited to complete or modified versions of cubes, cuboids, spheres, round cylinders, cylinders with discrete vertices, cones, triangular prisms, hexagonal prisms, triangular-based pyramids, square-based pyramids, and hexagonal pyramids. Moreover, instead of comprising the flat exterior surfaces depicted in FIG. 9, in some instances one or more exterior faces of the chambers 44 for the decorative displays can include other surfaces, or combinations thereof, including but not limited to surfaces in the shapes of arches, corrugations, convex indentations, concave protrusions, dimples, curves, cylinders, domes, gables, gambrels, peaks, pyramids, ridges, rhombic shapes, and half-spheres. In some instances, the chamber arrays 42 can be interchangeable so that consumers can switch exterior configurations without having to purchase new frames 20 or new LED lighting systems.

In some instances, a single illuminated wreath can include dual chamber arrays 42 so that when hung in a window one of the chamber arrays 42 faces outdoors while the other chamber array 42 faces indoors. In some instances of dual-chamber arrays, the frame 20 can include transparent material so that light from a single set of LEDs 30 can better reach both chamber arrays. In some instances of dual-chamber arrays, the LED lighting system can include two sets of LEDs 30 synchronized by a single LED controller 31.

In some instances, the at least one chamber array 42 of the decorative display can be fabricated as a plurality of segments that is pieced together using any of a variety of fasteners. In some examples, each segment of the chamber array 42 can include a plurality of built-in joining elements that is pieced together with corresponding built-in joining elements located on other parts of the decorative display, including but not limited to parts of the frame 20 and/or other parts of the chamber array 42. In some instances, the final assembly of the chamber array 42 can be performed by the consumer to reduce the costs of manufacturing, warehousing, packaging, and shipping.

In some instances of the decorative displays, one or more LEDs 30 can be attached to the chamber array 42 instead of the frame 20. For example, rather than being directly mounted to the frame 20, in some instances the top frame wall 21 depicted in FIG. 1 and FIG. 6 can instead be plastic welded or molded into the underside of the chamber array 42. Accordingly, as used herein, including the claims, the phrase "mounted at least indirectly" means that where a part X is mounted to a part Y and the part Y is, in turn, mounted to a part Z, then the part X is "mounted at least indirectly" to the part Z. Under this definition, if one or more LEDs 30 are attached to part of the chamber array 42 and in turn, one or more parts of the chamber array 42 are attached to the frame 20, then such LEDs 30 are "mounted at least indirectly" to the frame 20. Concomitantly, one or more LEDs 30 are also "mounted at least indirectly" to the frame 20 if such LEDs 30 are mounted to the top frame wall 21 as depicted in FIG. 6 and FIG. 7.

It should be understood that in other examples the decorative displays, including the illuminated wreaths and the illuminated trees, can be fabricated in any of a wide variety of shapes, including but not limited to shapes less ringlike than the examples depicted in the referenced drawings. These shapes include but are not limited to hearts, stars, candy canes, peace signs, interlocking rings, squares, triangles, diamonds, crescents, shamrocks, crosses, letter shapes (A, B, C, etc.), and number shapes (1, 2, 3, etc.). In some instances, these shapes can include hollow or partially hollow midsections. In other instances, the midsections can be solid. In some examples, the decorative displays or some of their various parts can be fabricated using a variety of plastic forming techniques, or any combination thereof. These techniques include but are not limited to injection molding, vacuum molding, extrusion molding, blow molding, compression molding, rotational molding, thermoforming, and 3-D printing. In some instances, some parts of the decorative displays can be constructed using stock materials.

Figure 16:
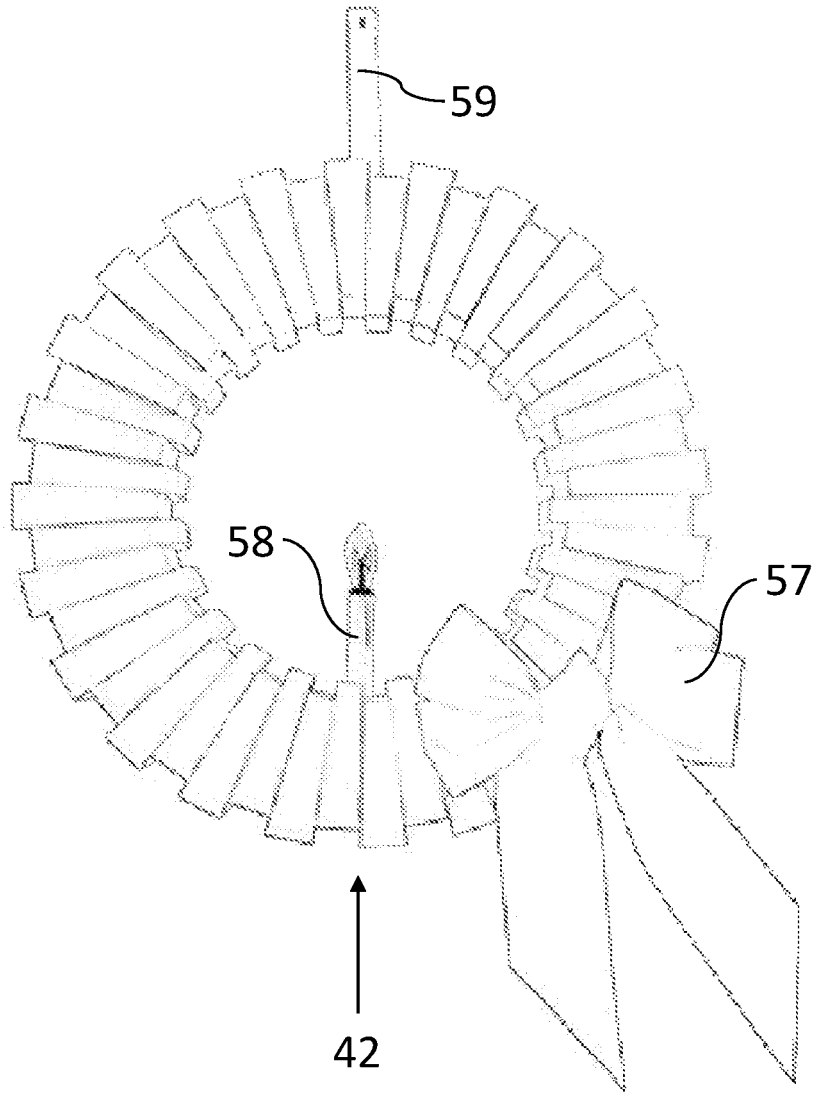
FIG. 16 shows an example illuminated wreath as exhibited with detachably attached decorations.

Exhibition—FIG. 16

As shown in the example of FIG. 16, a number of decorations such as a bow 57 and a battery-powered candle 58 can be detachably attached to the exterior of the illuminated wreath. The designs and colors of such decorations can vary depending upon the holiday being celebrated. The decorations can be attached using any of a variety of fasteners. To limit interference with light emanating from the illuminated wreath, in some instances decorations can be positioned in unilluminated areas of the illuminated wreath, as is the case with the battery-powered candle 58 positioned in the hollow center of the display. In other instances where decorations overlap a part of the chamber array 42, as is the case with the bow 57, such decorations can include light-transmitting or see-through mesh materials. In yet other instances, decorations can be separately illuminated by their own set of onboard LEDs. In some examples, such illuminated decorations can tap into the LED lighting system as a power source. As shown in the example of FIG. 16, a hanger 59 can be used to attach the illuminated wreath to substantially vertical surfaces including but not limited to walls, doors, or windows. In some instances, wires connecting the illuminated wreath to a power source can be partially hidden beneath or within the hanger 59.

In the example of FIG. 16, the chambers 44 and, concomitantly, the partitions 46, cover the top frame wall 21 so as to completely shield it from view. This bolsters the illuminated wreath's visual appeal because from most angles of view onlookers can see only decorative elements i.e., the chamber array 42 and decorations 57-58—while the wreath's non-decorative elements e.g., the top frame wall 21, the side walls 22, the multiple sets of internal wires 40-41, 43, the coupling bolts 48, the coupling nuts 56, etc.—remain out of sight.

The addressable LEDs 30 in the decorative displays emit a variety of colors that can vary depending on the holiday being celebrated. This boosts the decorative displays' versatility. For example, not only can Christmas-themed animations be shown in palettes such as red and green, the decorative displays can also show palettes associated with other holidays: greens and whites for St. Patrick's Day; USA flag colors for Independence Day; oranges and violets for Halloween, etc.

Illuminated Tree—FIGS. 17-19A

Several decorative displays can be used to form an illuminated tree. One way this can be accomplished is by horizontally placing layers of progressively smaller displays up the length of a center post 60. Each decorative display layer comprises elements described above in connection with the illuminated wreath: the frame 20, the plurality of addressable LEDs 30, the plurality of chambers 44 that form the chamber array 42, and the plurality of partitions 46.

Figure 17:
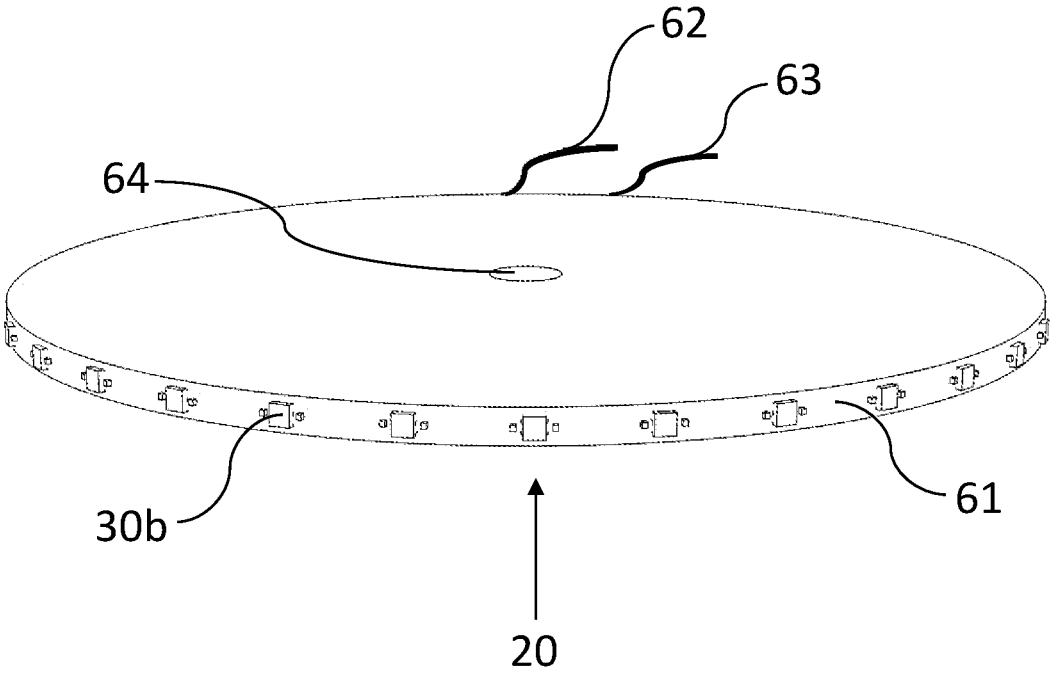
FIG. 17 shows an example illuminated tree frame with an LED strip affixed to its perimeter.

FIG. 17 shows the example frame 20 for one layer of the illuminated tree. In this example, the addressable low-profile LEDs 30*b* are part of an LED strip 61 affixed to the outer perimeter of the frame 20 using double-sided adhesive tape. A set of incoming wires 62 electrically connects with plugs or the like to another LED strip (not shown) located on the decorative display layer below the depicted frame 20. A set of outgoing wires 63 electrically connects with plugs or the like to yet another LED strip (not shown) located on a decorative display layer above the depicted frame 20. As FIG. 17 shows, the frame 20 further comprises a mounting hole 64 that fits over the top of the center post 60. In the example shown, the frame 20 comprises a flattened disc with a single hole. In other instances, the flattened disc can include cut-outs or latticed structures to save on materials and reduce the illuminated tree's weight. Moreover, in other instances, the frame 20 can assume other shapes, including but not limited to tubular rings, wheel-like rims, spoked rims, frames with side walls, and spools. In embodiments that use bullet-shaped LEDs 30*a*, such LEDs can be inserted into side frame walls 22 that include LED insertion holes 23 like those depicted in FIG. 1. It should be understood that in some instances, still other techniques can be used for attaching the LEDs 30 to the frames 20 including any of a wide variety of fasteners.

Figure 18:
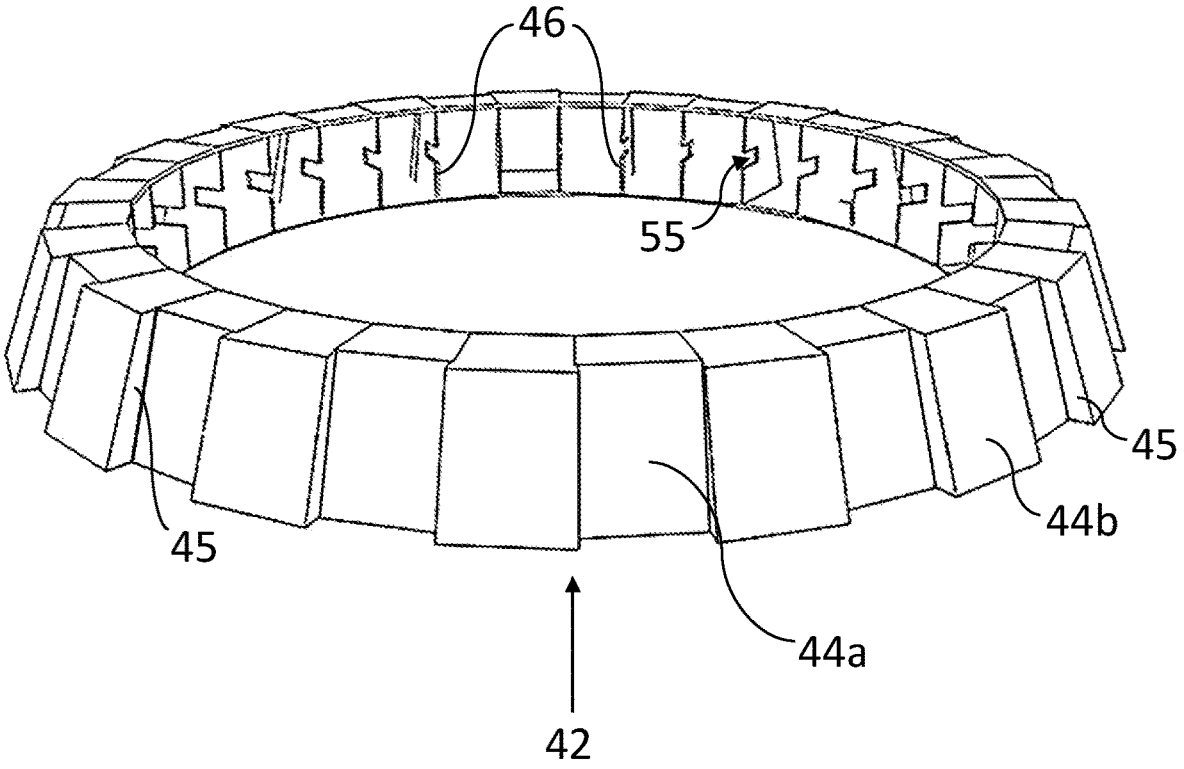
FIG. 18 shows an example chamber array of an illuminated tree without the frame installed.

FIG. 18 shows an example chamber array 42 for one decorative display layer of an illuminated tree. For clarity of illustration FIG. 18 omits any depiction of the frame 20. In this embodiment, the chamber array 42 includes a number of hollow chambers 44 in the substantial shape of trapezoidal prisms that have been assembled in an annular shape. As was the case with one of the examples described above for the illuminated wreath, the illuminated tree chamber array 42 in this example alternates small chambers 44*a* with large chambers 44*b*. The alternating placement of different-sized chambers 44*b* produces a pattern of ridges and valleys along at least one exterior surface of the chamber array 42. In examples employing other arrangements or shapes, the chamber array 42 can exhibit different patterns of ridges and valleys. Such ridges and valleys boost the visual interest of illuminated trees even when such displays are unlit.

In FIG. 18 each of the chambers 44 has multiple faces exposed to view, including a bottom face (not shown). The chamber 44 side faces 45 are only partially exposed to view. Inside the chamber array 42, the side faces 45 for each chamber overlap with the side faces 45 of adjacent chambers 44 to form translucent-to-opaque partitions 46 that are double layered. These double-layered partitions 46 at least reduce or completely block the transmission of light between adjacent chambers 44. In some instances, adjacent chambers 44 can be fabricated to share single-layered partitions 46, the properties of which (e.g., thickness, light absorbability, light reflectiveness, and combinations thereof) can be calibrated to acceptably limit light transmissions while also limiting fabrication costs. In other instances, the confinement of light can be achieved by constructing the partitions 46 as separate pieces that include one or more translucent-to-opaque materials. It should be understood that although the translucent materials contained in the chamber arrays 42 and individual chambers 44 will typically be white, other translucent colors can be used. Such tinted chambers 44 can alter the perceived hue of light emissions from the LEDs 30, but in certain cases that will be an acceptable or even desired result.

FIG. 18 also shows a row of the notches 55 on the chambers' partitions 46. In this example, the notches 55 slidably mount onto the frame 20 so that the chambers 44 making up the chamber arrays 42 are held in place entirely by frictional force. In examples that involve sufficiently strong connections between the chambers 44 and the frame 20, the chambers do not need to be connected to each other using snap-fit connectors or other fastening techniques. In other instances, the chambers 44 can be mounted upon the frames 20 using any of a variety of fasteners. In some of these embodiments, the chambers 44 and/or the frames 20 may be constructed to include added structures known in the art to facilitate secure mountings. In the example of FIG. 18, the backsides of the chambers are unenclosed except for the area, demarcated by the notches 55, that is to be occupied by the frame 20. In other embodiments, this unenclosed backside area can instead be enclosed with materials that at least reduce or completely block light transmissions. In some cases, one or more interior surfaces of the chambers 44 can include reflective materials to boost the transmission of light through the exposed faces of the chamber arrays 42. In the example of FIG. 18, a single row of the notches 55 is shown. In examples involving taller chambers 44 that require greater illumination, the chambers 44 can include one or more additional rows of the notches so that each chamber can be lit by multiple LEDs 30.

Figure 19:
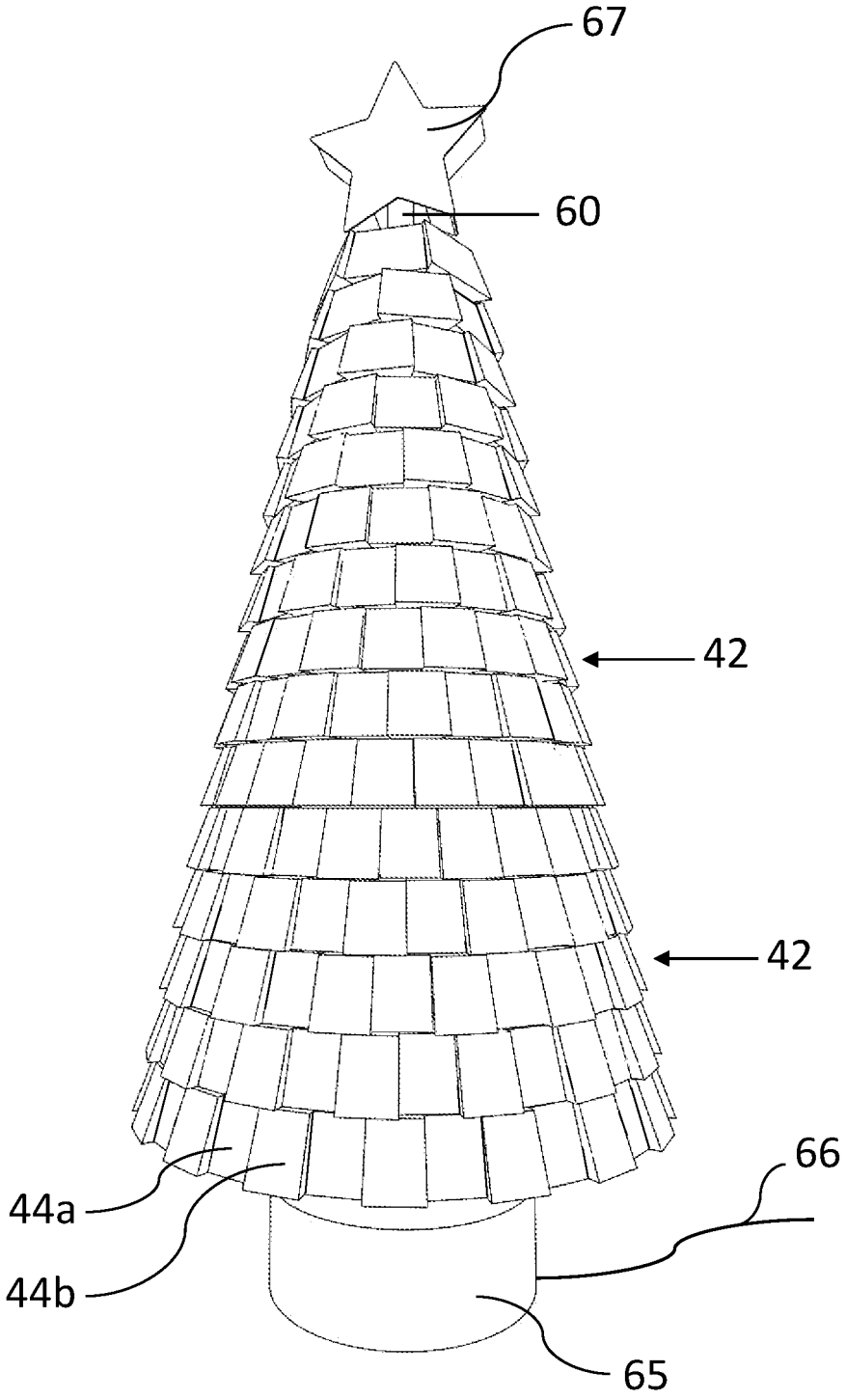
FIG. 19 shows an example illuminated tree as exhibited with a topper and a base.

FIG. 19 shows incrementally smaller wreathlike assemblages mounted up the length of the center post 60 to form an illuminated tree. In the example of FIG. 19 the center post 60 fits into a substantially hollow base 65 that can also be used to house elements of the LED lighting system, including the at least one LED controller 31, various electrical connections to the LEDs 30, and also one or more electrically connected signaling devices 32, if any are included. A power cord 66 electrically connects the LED lighting system to a conventional direct current power supply 35 and/or conventional alternating current power source 34. The LED lighting system for the illuminated tree is substantially as diagrammed in FIGS. 3-5, but in other instances can also take the form of other configurations.

In the example of FIG. 19, additional decoration is provided by a topper 67 mounted to the center post 60. In other embodiments, the topper 67 can assume other shapes. The upper terminus of the LED strips 61 can be electrically connected to the topper 67 via wires and plugs or the like that conduct electrical current and data to the topper's own onboard LED lights. In still yet other instances, the topper 67 can shine independently of the rest of the illuminated tree. An independent topper 67 can be electrically powered through various methods, including batteries located within the topper 67 or wires with plugs or the like that transit down the center post's 60 interior and exit to electrically connect to a power source.

Figure 19A:
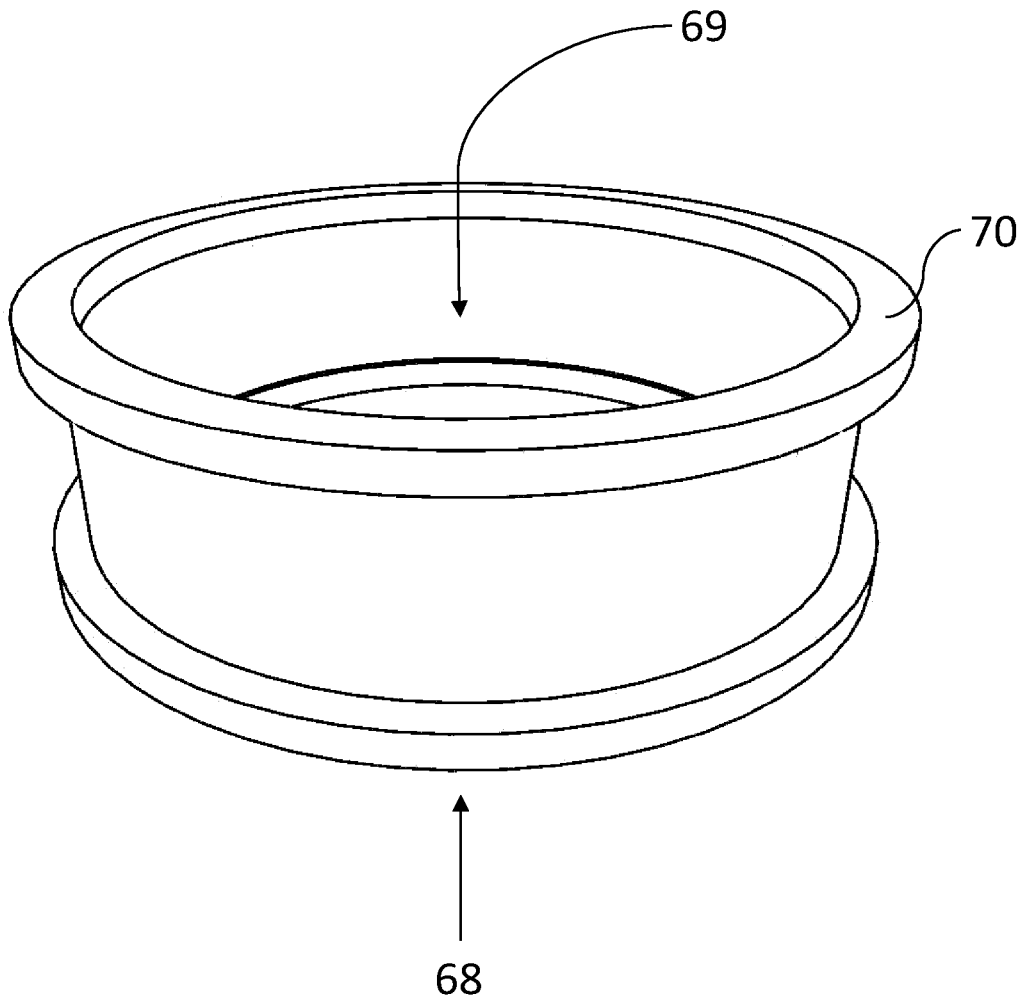
FIG. 19A shows an example center post spacer in the form of a spool.

The frames 20 of the illuminated tree can be mounted to the center post 60 using any of a variety of center post spacers. In some instances, the chamber arrays 42 can simply be stacked upon each other. In such instances, center post spacers are omitted and the vertical distance between each of the frames 20 is determined by the horizontal height of the chamber arrays 42. In other instances, the top faces of all but the smallest chamber array 42 can include a plurality of protrusions that supports the bottom face of the next-higher chamber array 42 that is positioned along the center post 60. In instances of such center post spacers, the vertical distance between each of the frames 20 is affected by the horizontal height of each chamber array 42 plus the height of its plurality of protrusions. In some embodiments, such chamber array 42 protrusions can be fabricated to fit into matching structures located on the bottom face of the center post's next-higher chamber array 42. In yet other examples, as shown in FIG. 19A, the center post spacers can comprise a number of spools 68. Each of the spools 68 includes a center hole 69 that facilitates its mounting over the center post 60. Each of the spools 68 can be interspersed along the center post 60 of the illuminated tree so that each frame 20 rests upon an upper flange face 70 of each spool. In the example of FIG. 19A, each frame is held upon each spool 68 by the force of gravity. In other instances, a more secure connection can be achieved in which the upper flange face 70 includes one or more protrusions (not shown) that fit into one or more matching connecting holes (not shown) located around the mounting hole 64 for each illuminated tree frame 20 (see FIG. 17). In yet other instances, the frames 20 can be mounted to the center post 60 using center post spacers in the form of conventional wide-bodied brackets or clamps that attach to the center post 60 at appropriate intervals, thereby providing—like the upper flange face 70 of the spool 68—a broad perch upon which can rest the frames 20. In some instances, the brackets or clamps can include one or more protrusions that fit into one or more matching holes located near each frame's mounting hole 64. In some instances, the center post 60 can include markings to indicate where each such bracket or clamp should be mounted.

The elements described for the decorative displays can be readily packaged in a convenient box and sold as a kit to be assembled by the consumer. One or more of the non-electrical elements discussed above, including the at least one frame 20, the chambers 44, the partitions 46, and, if applicable, the center post 60, can be delivered as segmented parts. In use, the consumer will unpack the kit and then piece together any disconnected non-electrical segments. The consumer will also electrically connect the elements of the LED lighting system, including the addressable LEDs 30, the at least one LED controller 31, the at least one electrically connected signaling device 32, if included, and the at least one source of electrical power 34-36. After the fully assembled and electrically connected decorative assembly is positioned in the desired location, it is ready for exhibition. During exhibition, the consumer can interact with the decorative display by operating the one or more signaling devices 32-33 to send lighting effect instructions to the at least one LED controller 31.

In various aspects, system elements, method steps, or examples described throughout this disclosure (such as the LED controller 31, or components thereof, for example) can be implemented on one or more computer systems, field programmable gate array (FPGA), application specific integrated circuit (ASIC) or similar devices comprising hardware executing code to realize those elements, processes, or examples, the code stored on a non-transient data storage device. These devices include or function with software programs, firmware, or other computer readable instructions for carrying out various techniques, process tasks, calculations, and control functions, used in a distributed antenna system.

These instructions are typically stored on any appropriate computer readable medium used for storage of computer readable instructions or data structures. The computer readable medium can be implemented as any available media that can be accessed by a general purpose or special purpose computer or processor, or any programmable logic device. Suitable processor-readable media may include storage or memory media such as magnetic or optical media. For example, storage or memory media may include conventional hard disks, Compact Disk-Read Only Memory (CD-ROM), volatile or non-volatile media such as Random Access Memory (RAM) (including, but not limited to, Synchronous Dynamic Random Access Memory (SDRAM), Double Data Rate (DDR) RAM, RAMBUS Dynamic RAM (RDRAM), Static RAM (SRAM), etc.), Read Only Memory (ROM), Electrically Erasable Programmable ROM (EEPROM), and flash memory, etc. Suitable processor-readable media may also include transmission media such as electrical, electromagnetic, or digital signals, conveyed via a communication medium such as a network and/or a wireless link.

The techniques and techniques described here may be implemented in digital electronic circuitry, or with a programmable processor (for example, a special-purpose processor or a general-purpose processor such as a computer) firmware, software, or in combinations of them. Apparatus embodying these techniques may include appropriate input and output devices, a programmable processor, and a storage medium tangibly embodying program instructions for execution by the programmable processor. A process embodying these techniques may be performed by a programmable processor executing a program of instructions to perform desired functions by operating on input data and generating appropriate output. The techniques may advantageously be implemented in one or more programs that are executable on a programmable system including at least one programmable processor coupled to receive data and instructions from, and to transmit data and instructions to, a data storage system, at least one input device, and at least one output device. Generally, a processor will receive instructions and data from a read-only memory and/or a random-access memory. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and DVD disks. Any of the foregoing may be supplemented by, or incorporated in, specially designed application-specific integrated circuits (ASICs).

A number of embodiments of the decorative displays defined by the following claims have been described. Nevertheless, it will be understood that various modifications to the described embodiments may be made without departing from the spirit and scope of the claimed decorative displays. Accordingly, other embodiments are within the scope of the following claims.

I claim:

1. A multichambered illuminated decorative display, comprising:

a frame;

a plurality of LEDs being mounted at least indirectly to the frame, the plurality of LEDs being interconnected so as to transmit electricity and data, each of the plurality of LEDs being addressable, each of the plurality of LEDs being capable of emitting light when powered;

an at least one LED controller being connected to the plurality of LEDs so as to transmit at least data;

a plurality of chambers being mounted at least indirectly to the frame and comprising translucent material, the plurality of chambers comprising a plurality of pairs of adjacent chambers, each of the plurality of chambers at least partially surrounding one or more of the plurality of LEDs, each of the plurality of chambers having an at least one chamber face comprising not only an interior chamber face surface but also an exterior chamber face surface that, at least in part, forms a portion of the exterior surface of the illuminated display, the at least one chamber face being configured to promote the substantially even distribution of LED emitted light over the exterior chamber face surface, whereby the display of diffused light is facilitated and the intensity of hot spots is reduced; and a plurality of partitions comprising translucent to opaque material, each of the plurality of partitions being interposed between a pair of adjacent chambers of the plurality of pairs of adjacent chambers, each of the plurality of partitions comprising a percentage by weight of the materials constituting each chamber of the plurality of chambers ranging from zero percent by weight of the materials of each such chamber to less than one hundred percent by weight of the materials of each such chamber, each of the plurality of partitions being configured to at least reduce the LED emitted light passing between the pair of adjacent chambers of the plurality of pairs of adjacent chambers, whereby the display of precise light animations is facilitated.

2. A multichambered illuminated decorative display adapted for use as an illuminated wreath, comprising:

a frame;

a plurality of LEDs being mounted at least indirectly to the frame, the plurality of LEDs being interconnected so as to transmit electricity and data, each of the plurality of LEDs being addressable, each of the plurality of LEDs being capable of emitting light when powered;

an at least one LED controller being connected to the plurality of LEDs so as to transmit at least data;

a plurality of chambers being mounted at least indirectly to the frame and comprising translucent material, the plurality of chambers comprising a plurality of pairs of adjacent chambers, each of the plurality of chambers at least partially surrounding one or more of the plurality of LEDs, each of the plurality of chambers having an at least one chamber face comprising not only an interior chamber face surface but also an exterior chamber face surface that, at least in part, forms a portion of the exterior surface of the illuminated wreath, the at least one chamber face being configured to promote the substantially even distribution of LED emitted light over the exterior chamber face surface, whereby the display of diffused light is facilitated and the intensity of hot spots is reduced; and a plurality of partitions comprising translucent to opaque material, each of the plurality of partitions being interposed between a pair of adjacent chambers of the plurality of pairs of adjacent chambers, each of the plurality of partitions comprising a percentage by weight of the materials constituting each chamber of the plurality of chambers ranging from zero percent by weight of the materials of each such chamber to less than one hundred percent by weight of the materials of each such chamber, each of the plurality of partitions being configured to at least reduce the LED emitted light passing between the pair of adjacent chambers of the plurality of pairs of adjacent chambers, whereby the display of precise light animations is facilitated.

3. The illuminated wreath of claim 2, wherein at least one of the plurality of chambers as measured by its exterior dimensions has a smaller volume than at least one other chamber of the plurality of chambers as measured by its exterior dimensions.

4. The illuminated wreath of claim 2, wherein the plurality of chambers and the plurality of partitions cover the frame so that when the illuminated wreath is exhibited on a substantially vertical opaque surface the frame from most viewing angles is hidden from view.

5. The illuminated wreath of claim 2, wherein at least one of the plurality of chambers is offset in at least one direction as compared to at least one other chamber of the plurality of chambers.

6. The illuminated wreath of claim 2, further comprising an at least one connecting structure for hanging the illuminated wreath.

7. The illuminated wreath of claim 2, further comprising an at least one signaling device for sending instructions to the at least one LED controller.

8. The illuminated wreath of claim 2, further comprising a direct current power supply electrically connected to the plurality of LEDs and the at least one LED controller.

9. The illuminated wreath of claim 2, further comprising an at least one battery pack mounted to the frame, the at least one battery pack electrically connected to the plurality of LEDs and the at least one LED controller.

10. The illuminated wreath of claim 2, further comprising an at least one weather protective cover that encloses an at least one electrically connected element of the illuminated wreath.

11. The illuminated wreath of claim 2, further comprising an at least one detachably attachable decoration.

12. The illuminated wreath of claim 2, further comprising a rear chamber array disposed on the side of the illuminated wreath opposite of the plurality of chambers, the rear chamber array being mounted at least indirectly to the frame.

13. A multichambered illuminated decorative display adapted for use as an illuminated tree, comprising:

a frame;

a plurality of LEDs being mounted at least indirectly to the frame, the plurality of LEDs being interconnected so as to transmit electricity and data, each of the plurality of LEDs being addressable, each of the plurality of LEDs being capable of emitting light when powered;

an at least one LED controller being connected to the plurality of LEDs so as to transmit at least data;

a plurality of chambers being mounted at least indirectly to the frame and comprising translucent material, the plurality of chambers comprising a plurality of pairs of adjacent chambers, each of the plurality of chambers at least partially surrounding one or more of the plurality of LEDs, each of the plurality of chambers having an at least one chamber face comprising not only an interior chamber face surface but also an exterior chamber face surface that, at least in part, forms a portion of the exterior surface of the illuminated tree, the at least one chamber face being configured to promote the substantially even distribution of LED emitted light over the exterior chamber face surface, whereby the display of diffused light is facilitated and the intensity of hot spots is reduced; and a plurality of partitions comprising translucent to opaque material, each of the plurality of partitions being interposed between a pair of adjacent chambers of the plurality of pairs of adjacent chambers, each of the plurality of partitions comprising a percentage by weight of the materials constituting each chamber of the plurality of chambers ranging from zero percent by weight of the materials of each such chamber to less than one hundred percent by weight of the materials of each such chamber, each of the plurality of partitions being configured to at least reduce the LED emitted light passing between the pair of adjacent chambers of the plurality of pairs of adjacent chambers, whereby the display of precise light animations is facilitated.

14. The illuminated tree of claim 13, wherein at least one of the plurality of chambers as measured by its exterior dimensions has a smaller volume than at least one other chamber of the plurality of chambers as measured by its exterior dimensions.

15. The illuminated tree of claim 13, further comprising an at least one signaling device for sending instructions to the at least one LED controller.

16. The illuminated tree of claim 13, further comprising an at least one power supply, the at least one power supply being electrically connected to the plurality of LEDs and the at least one LED controller.

17. The illuminated tree of claim 13, further comprising an at least one weather protective cover that encloses an at least one electrically connected element of the illuminated tree.

18. A kit for assembling a multichambered illuminated decorative display, comprising:

a frame;

a plurality of LEDs being mounted at least indirectly to the frame, the plurality of LEDs being interconnected so as to transmit electricity and data, each of the plurality of LEDs being addressable, each of the plurality of LEDs being capable of emitting light when powered;

an at least one LED controller being connected to the plurality of LEDs so as to transmit at least data;

a plurality of chambers being mounted at least indirectly to the frame and comprising translucent material, the plurality of chambers comprising a plurality of pairs of adjacent chambers, each of the plurality of chambers at least partially surrounding one or more of the plurality of LEDs, each of the plurality of chambers having an at least one chamber face comprising not only an interior chamber face surface but also an exterior chamber face surface that, at least in part, forms a portion of the exterior surface of the illuminated display, the at least one chamber face being configured to promote the substantially even distribution of LED emitted light over the exterior chamber face surface, whereby the display of diffused light is facilitated and the intensity of hot spots is reduced;

a plurality of partitions comprising translucent to opaque material, each of the plurality of partitions being interposed between a pair of adjacent chambers of the plurality of pairs of adjacent chambers, each of the plurality of partitions comprising a percentage by weight of the materials constituting each chamber of the plurality of chambers ranging from zero percent by weight of the materials of each such chamber to less than one hundred percent by weight of the materials of each such chamber, each of the plurality of partitions being configured to at least reduce the LED emitted light passing between the pair of adjacent chambers of the plurality of pairs of adjacent chambers, whereby the display of precise light animations is facilitated; and an at least one power supply, the at least one power supply being electrically connectable to the plurality of LEDs and the at least one LED controller.

19. The kit of claim 18, further comprising a plurality of center post segments, each of the plurality of center post segments being detachably attachable to an adjacent center post segment, wherein the at least one frame further comprises a mounting hole that passes through its center, wherein the at least one frame through the mounting hole fits over the top of the plurality of center post segments as detachably attached.

20. The kit of claim 18, further comprising an at least one signaling device for sending instructions to the at least one LED controller.

21. The kit of claim 18, further comprising an at least one weather protective cover that encloses an at least one electrically connectable element of the kit.

* * * * *